US007454943B2

(12) United States Patent
Jacobsen

(10) Patent No.: US 7,454,943 B2
(45) Date of Patent: Nov. 25, 2008

(54) ARTICULATED BENDING BRAKE FOR SHEET METAL FORMING

(75) Inventor: Hans Jacobsen, Seattle, WA (US)

(73) Assignee: Tooling Innovations, Inc., Seatac, WA (US)

( * ) Notice: Subject to any disclaimer, the term of this patent is extended or adjusted under 35 U.S.C. 154(b) by 801 days.

(21) Appl. No.: 10/620,243

(22) Filed: Jul. 15, 2003

(65) Prior Publication Data

US 2005/0011247 A1 Jan. 20, 2005

(51) Int. Cl.
*B21D 5/02* (2006.01)
*B21D 9/05* (2006.01)
*B21D 41/00* (2006.01)

(52) U.S. Cl. ..... 72/389.8; 72/396; 72/383

(58) Field of Classification Search ..... 72/31.1, 72/31.11, 313, 383, 389.1, 389.2, 389.3, 72/389.4, 389.8, 389.9, 396, 481.9, 702; 100/35

See application file for complete search history.

(56) References Cited

U.S. PATENT DOCUMENTS 2,433,841 A * 1/1948 Glud ..... 72/396
3,258,948 A * 7/1966 Carlson ..... 72/57
5,060,501 A * 10/1991 Heath ..... 72/382
5,295,384 A * 3/1994 Schubert ..... 72/389.4
5,295,385 A * 3/1994 Murai ..... 72/389.4
5,365,766 A * 11/1994 Takahashi et al. ..... 72/387
5,495,743 A 3/1996 Kawano ..... 72/481.9
6,000,322 A 12/1999 To ..... 100/35
6,173,599 B1 * 1/2001 Stepanenko et al. ..... 72/383
6,263,717 B1 7/2001 Nojiri ..... 72/313
6,715,334 B2 * 4/2004 Kimura et al. ..... 72/389.8
6,959,573 B2 * 11/2005 Matsumoto et al. ..... 72/31.11

OTHER PUBLICATIONS

Fab Supply Incorporated. ND. "Press Brake Tooling for the Sheet Metal Industry." 6pp. Available http://www.fabsupplyinc.com/index.php?page=shop/browse_rolla&category_id=9269d333.
Wing Bend. ND. "Specifications of Wing Bend." 11pp. Available http://www.wingbend.com/WINGBEND%20SPECIFICATIONS.htm.

* cited by examiner

*Primary Examiner*—Derris H. Banks
*Assistant Examiner*—Teresa Bonk
(74) *Attorney, Agent, or Firm*—Ronald M. Anderson

(57) ABSTRACT

A bottom tool/bending die for use in sheet metal forming. The bottom tool includes a pair of movable dies that provide substantially continuous support of a work piece as it is being deformed. Each die includes an upper surface configured to contact the work piece and having an inner and an outer edge. As the die moves in the tool, the inner edge of the upper surface is closer to a center of rotation of the die than the outer edge. In some embodiments, the upper surfaces of the dies are shaped so that a fixed separation is maintained between the inner edges of the dies as they rotate. In at least one embodiment, sector gears are used to control the motion of the dies.

18 Claims, 26 Drawing Sheets

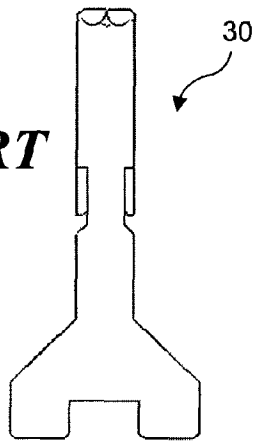
FIG. 2A
PRIOR ART
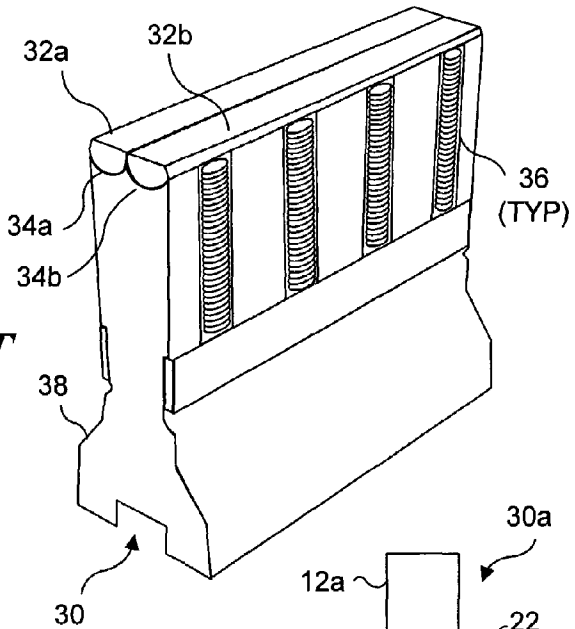
FIG. 2B
PRIOR ART
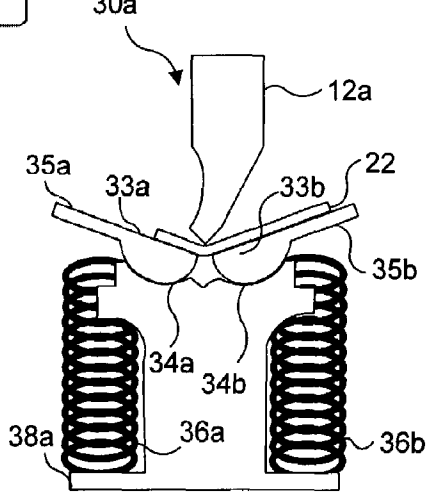
FIG. 2C
PRIOR ART
FIG. 2D
PRIOR ART
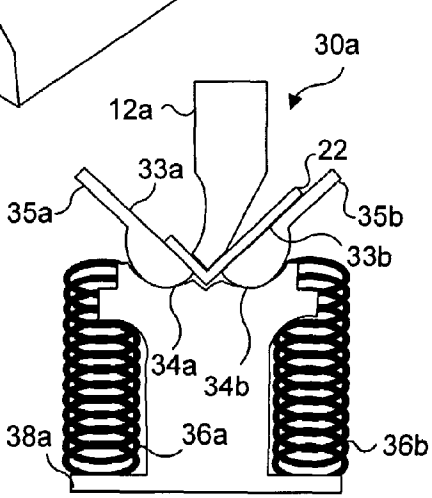
FIG. 2E
PRIOR ART

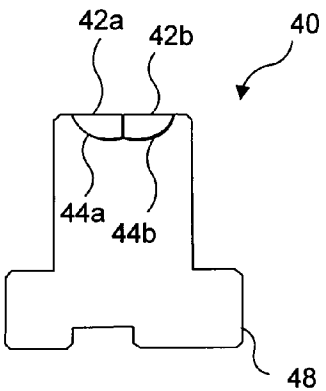
FIG. 3A
PRIOR ART
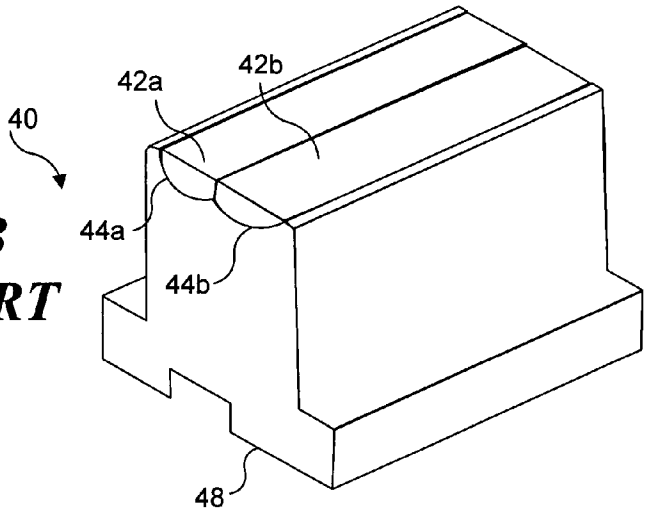
FIG. 3B
PRIOR ART
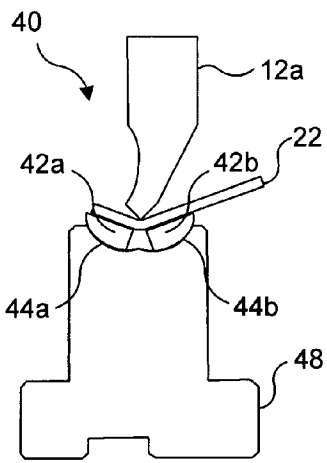
FIG. 3C
PRIOR ART
FIG. 3D
PRIOR ART
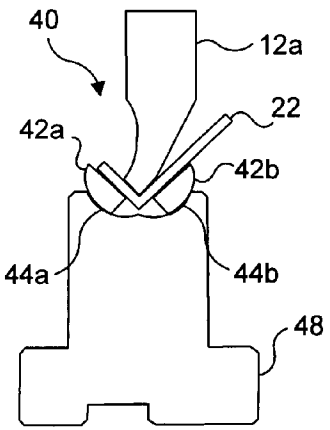
FIG. 3E
PRIOR ART

ARTICULATED BENDING BRAKE FOR SHEET METAL FORMING

FIELD OF THE INVENTION

The present invention relates to a press brake for bending sheet metal, and more specifically, to a press brake die having a pair of surfaces for supporting sheet metal that rotate in response to an applied pressure, while maintaining a defined relationship to each other.

BACKGROUND OF THE INVENTION

A press brake typically includes an upper piston or punch that is driven into sheet metal, deforming the sheet metal as controlled by a lower die. The upper punch may have an elongate V-shaped edge that causes the sheet metal bend along the edge of the tool, and the die defines a corresponding elongated V-shaped groove to control the bending of the sheet metal. Other shapes are used on the punch in cooperation with a die having a specific shape and size of elongate slot to produce various forms of bent sheet metal. The sheet metal to be bent in a press brake is placed between the punch tool and the die, and the punch tool, which is vertically aligned with the die, presses downwardly upon the sheet metal with sufficient force to bend the sheet metal into the shape defined by the die and the punch tool.

FIG. 1A illustrates a prior art or conventional press brake. The upper tool is a simple punch 12, although it should be understood that punches are often removably mounted to an arm so that different sized or shaped punches can be employed. A bottom tool 14 includes a base 20, a die holder 18, and a V-shaped die 16. A work piece 22 (i.e., a piece of sheet metal) to be formed is placed between punch 12 and die 16. In FIG. 1B, punch 12 has been forced to move downwardly, to contact work piece 22. As work piece 22 is forced into the V-shaped groove of die 16 by the punch, the work piece deforms. FIG. 1C shows punch 12 in a fully extended position, after work piece 22 has been formed into a configuration in which it is bent into about a 90° angle.

The specific configuration into which the work piece is formed by the punch and die is a function of the size and shape of the groove or channel defined by the die (and in some cases, a function of the punch size and shape). If a different configuration is required, then die 16 must be removed from die holder 18, and replaced with a die having a groove or channel appropriate to achieve the desired different configuration. While a plurality of different dies may provide the required flexibility to achieve a variety of required shapes when bending sheet metal, such flexibility comes at a cost. Press brakes are most often found in smaller commercial facilities where cost and efficiency are important concerns. The time required to remove a die and replace it with a different die reduces productivity. Further, the dies are relatively costly. While simple in shape, the dies can be quite massive, particularly for large press brakes. Also, to increase the service life of such dies, they are often formed of a hardened or tempered metal alloy, further increasing their cost. It would thus be desirable to provide a less costly press brake bottom tool die that is reconfigurable without replacing the die. It would further be desirable to provide a single press brake bottom tool die that can be used to produce a variety of different configurations when bending sheet metal, both to avoid requiring different dies, and to reduce productivity loss due to the time required to change dies.

A different type of prior art press brake die, which is manufactured by TSH International, of Tokyo, Japan, is shown in FIGS. 2A-2E. Instead of the working surface of the die comprising a single component having a fixed groove or channel, two movable dies generally shaped like half cylinders are disposed in corresponding elongate channels. FIGS. 2A and 2B respectively provide an end view and an isometric view of a wing die 30; the laterally extending plates on each die are not shown to simplify the drawing. Two elongate dies 32*a* and 32*b*, which are shaped like half cylinders, are disposed in corresponding channels 34*a* and 34*b*, at the top end of wing die 30. A plurality of springs 36 ensure that dies 32*a* and 32*b* return to their original positions after being moved during metal forming, as will be described in greater detail below. Channels 34*a* and 34*b* are formed into a base 38, and springs 36 are secured to base 38. Note that in addition to returning the dies to their original positions, the springs provide a desirable resisting force while bending metal.

As with other types of press brake tooling, wing dies are used in conjunction with an upper tool, shown as a punch 12*a* in FIGS. 2C-2E. Note that many different types of upper tools, or punches, are available. Both punch 12 of FIG. 1A-1C and punch 12*a* apply a top loading force against a work piece. FIGS. 2C-2E illustrate a somewhat modified wing die 30*a* that also includes dies shaped like a half cylinder, and which fit in corresponding channels in the base, similar to the elongate channels of wing die 30. However, dies 33*a* and 33*b* respectively include wings 35*a* and 35*b*, which extend beyond the half-cylinder shaped portion of the dies. A plurality of springs 36*a* are coupled to wing 35*a*, and a plurality of springs 36*b* are coupled to wing 35*b*. Thus, springs 36*a* are operative to return die 33*a* to its original position, and springs 36*b* are operative to return die 33*b* to its original position, after the force of the punch and the formed work piece are withdrawn. Again, the springs also provide a desirable resisting force when bending metal. Springs 36*a* and 36*b* are attached to each wing at spaced apart intervals along the longitudinal axis of the dies. Also, base 38*a* of FIGS. 2C-2E is smaller than base 38 in FIG. 2B. Wings are preferably included on dies of FIGS. 2A and 2B as well, although these wings are significantly smaller, providing only sufficient material to engage springs 36, and not forming a portion of the surface that assists in forming the work piece as the punch is advanced.

As shown in FIG. 2C, work piece 22 is placed on top of dies 33*a* and 33*b*, such that the area where the bend is to be formed is disposed at the juncture of dies 33*a* and 33*b*. Punch 12*a* is moved downward until it contacts the work piece. As work piece 22 is forced downwardly by punch 12*a*, dies 33*a* and 33*b* (on wing die 30*a*) tend to rotate about their respective longitudinal axes, within channels 34*a* and 34*b*, as can be seen by comparing FIG. 2C with FIG. 2D. Contrast FIG. 1B with FIG. 2D.

In FIG. 1B, the portion of work piece 22 immediately over the vertex of the V-shaped groove is unsupported. In FIG. 2D, more of work piece 22 is supported by the dies, reducing strain on the work piece. FIG. 2E shows punch 12*a* in a more fully extended position, illustrating that work piece 22 has been formed to have an approximate right angle bend. Springs 36*a* and 36*b* are under tension, ready to exert a restoring force upon dies 33*a* and 33*b*, respectively, to return the dies to their original positions, once punch 12*a* is withdrawn and the work piece has been removed.

While representing a substantial improvement over the prior art tooling shown in FIG. 1A-1C, particularly with respect to providing enhanced support to work piece 22, wing die 30*a* employs dies 33*a* and 33*b* (wing die 30 similarly employs dies 32*a* and 32*b*) that move apart from each other as the punch applies force against the work piece. Thus, there is not a fixed relationship between the two dies, and their spacing depends upon the extension of the punch. Also, wing die 30 and 30*a* are fixed tools, in that unlike die 16 of FIGS. 1A-1C, dies 33*a* and 33*b* of wing die 30*a* (and dies 32*a* and 32*b* of wing die 30) are not designed to be replaced with dies allowing different shaped bends to be achieved. This drawback is somewhat offset by the fact that continued advancement of punch 12*a*, past the partially extended position required to achieve a right angle bend, enables smaller angle bends to be achieved, as the sheet metal is forced further into the gap between the dies.

Still another type of prior art press brake tool is illustrated in FIGS. 3A-3E, which schematically show a ROLLA-V™ roller die 40 like that sold by Falcon Machine Tools Limited, of Stourbridge, UK. Similar to the wing die described above, roller die 40 includes two dies 42*a* and 42*b* that are shaped like elongated half cylinders, each respectively disposed in correspondingly shaped elongate channels 44*a* and 44*b*. While dies 42*a* and 42*b* are disposed on the upper portion of a base 48, no springs are included to return the dies back to their original positions.

FIGS. 3C-3E schematically illustrate roller die 40 and punch 12*a* being used to deform a work piece 22. In FIG. 3C, work piece 22 has been positioned atop the upper surfaces of dies 42*a* and 42*b*, with the area where the bend is to be formed disposed at the juncture of dies 42*a* and 42*b*. In FIG. 3D, punch 12*a* has been forced downwardly to contact work piece 22, beginning the deformation or bending process. Again, as work piece 22 is forced downwardly into dies 42*a* and 42*b*, the dies rotate within their respective channels 44*a* and 44*b*, providing support for the work piece, but rotating apart as the punch advances. FIG. 3E shows punch 12*a* in a more fully extended position, after approximately a 90° bend has been formed in work piece 22. Again, this prior art device also suffers from the same drawback as the press brake shown in FIGS. 2A-2E; namely, the gap between the dies increases as they rotate, so that the spacing between the dies does not remain fixed, but instead changes as a function of the extension of the punch, increasing as the angle of the bend increases.

It would be desirable to provide a press brake bottom tool die that enables superior support for a work piece as compared to the prior art dies, such as those discussed above. It would further be desirable to provide a bottom tool in which the spacing between the dies remains fixed while the die is used. Preferably, this press brake die assembly should include adjustment features enabling a variety of bends to be formed with a single die assembly.

It is further desirable to provide a press brake bottom tool die that enables short leg bends to be achieved. Short leg bending refers to forming a bend in a piece of sheet metal relatively close to an edge of the sheet metal, such that a short leg is defined between the bend and the edge. Most existing tooling does not facilitate short leg bending.

SUMMARY OF THE INVENTION

A first aspect of the present invention is directed to a bending die for forming sheet metal. The bending die includes both a first and second working surface disposed adjacent to each other. The working surfaces provide substantially continuous support of the work piece. Each working surface includes an upper surface configured to contact the work piece, and each upper surface includes an inner and an outer edge. Associated with each working surface is a center of rotation. Regardless of the motion of the working surface in the tool, the inner edge of the upper surface is closer to the center of rotation than the outer edge. In some embodiments, the shape of the upper surface is such that a fixed separation between the inner edges of each working surface is maintained regardless of the displacement of the working surface.

In one embodiment, at least one hinge assembly movably couples the first and second working surfaces, such that a displacement of one of the first and second working surfaces results in a corresponding displacement of the other of the first and second working surfaces. A frame provides support for each at least one hinge assembly, while enabling the first and second working surfaces a range of motion.

Also preferably, the bending die includes a return spring that returns the at least one hinge assembly and the first and second working surfaces to their respective original positions after a displacement of the first and second working surfaces occurs. A return spring can be included in each hinge assembly.

Generally, the first and second working surfaces are substantially equivalent in size and shape. In at least one embodiment, each working surface is a metal plate. In other embodiments, the working surface is formed from an elongated quarter round bar, and in one embodiment, teeth are formed into the arcuate portion of the quarter round bar. The teeth of the working surface engage rack gears disposed in a frame supporting the working surfaces.

An element of some of the embodiments of bending dies in accord with the present invention is the use of a rack gear and a sector gear to control the motion of the working surfaces. Each rack gear is attached to the frame. In one preferred embodiment, the bending die includes a first rack gear and a first sector gear, and a second rack gear and a second sector gear. Each sector gear is coupled to the working surface. Preferably, each sector gear is one fourth of a circular gear.

The frame of the bending die preferably includes at least one generally U-shaped member, which includes a pair of elongate arms, such that each rack is attached to a different elongate arm. In at least one embodiment, each elongate arm is a separate component. The frame may include a bottom plate, each generally U-shaped member being attached to the bottom plate.

Another aspect of the invention is an adjustable frame, such that the first and second working surfaces can be separated by a gap having a desired size. The elements of the frame can be moved closer together to achieve a smaller gap, or farther apart to achieve a larger gap. A gap is particularly useful for forming a channel into a work piece. An adjustable gap enables different sized channels to be formed.

In one embodiment particularly well adapted to form a channel in a work piece, each of the first and second working surfaces includes a flange tip adapted to support a work piece as the bending die is used to form a channel in a work piece. In a related embodiment, each of said first and second working surfaces includes a flange tip and an angled upper surface. Preferably, in an embodiment useful for forming a channel in a work piece, adjacent edges of the working surfaces include rounded shoulders. Each embodiment useful for forming a channel in a work piece preferably further includes a movable support disposed adjacent to the first and second working surfaces, such that a displacement of one of the first and second working surfaces results in a corresponding displacement of the movable support. In at least one embodiment, the movable support includes a channel having a dimension substantially equal to the gap separating the adjacent edges of the working surfaces. An elongate block is disposed in that channel, the elongate block having a dimension smaller than the gap. A spring element is disposed in the channel and coupled to the elongate block, so that the elongate block is disposed within the channel and is in contact with the work piece. As the upper tool applies a downward pressure to the work piece, the spring coupled to the elongate block compresses, and the elongate block is forced into the channel. As the elongate block is forced into the channel, the work piece is forced into the gap separating the working surfaces, thereby forming a channel. The spring coupled to the elongate block ensures that the elongate block remains in contact to the work piece as the channel is being formed. Preferably, the movable support is mounted onto a collapsible support that is attached to the frame, and disposed adjacent to the movable support, such that a displacement of the movable support causes a corresponding displacement of the collapsible support. This enables the movable support a sufficiently large range of motion to accommodate the formation of a channel in the work piece.

Bending dies in accord with the present invention preferably include a resist element configured to apply a resisting force to the working surfaces, in a direction opposing a force applied by an upper tool to bend the work piece. The resist element can include one or more springs, hydraulic components, pneumatic components, or elastomeric materials.

In another embodiment, each working surface is drivingly coupled with a driven gear. The driven gear is configured to couple to a prime mover, such that the prime mover can rotate the driven gear, causing a corresponding movement in the working surfaces. This configuration is useful for forming operations in which an upper tool is held in a fixed position, while the working surfaces are driven to bend the work piece.

In a related embodiment, each working surface is drivingly coupled with at least a hydraulic system, a pneumatic system, or a mechanical system, to drive the working surfaces when forming a material.

Another aspect of the present invention is directed to a press brake tool for use in sheet metal forming. Such a tool is adapted to be used in conjunction with a piston, and includes a frame and both a first and second die disposed adjacent to each other. The dies are movable and provide substantially continuous support of the work piece. Each die includes an upper surface configured to contact the work piece, and each upper surface includes an inner and an outer edge. As noted above, each die has a center of rotation, and the frame supports the dies such that regardless of the motion of the dies, the inner edge of the upper surface is always closer to the center of rotation than the outer edge. The shape of the upper surface is preferably chosen such that a fixed separation between the inner edges of each die is maintained regardless of the displacement of the working surface. Even when the upper surface is shaped so that some variation in the separation between the inner edges of the adjacent dies occurs, the variation is minimal, and the separation is substantially fixed.

One embodiment of the press brake includes a rack and sector gear system to control the motion of the dies. The gear system includes a plurality of individual rack gears and sector gears, each rack gear being attached to the frame. The press brake also includes a first plate die coupled to at least one of the sector gears, and a second plate die coupled to a different one of the sector gears. The rack and sector gear system ensures that a displacement of one of the first and second plate dies results in a corresponding displacement of the other of the first and second plate dies. Each sector gear is approximately one fourth of a circular gear.

Other embodiments employ different mechanisms to control motion of the dies, including driven gears coupled to sector gears coupled with the dies, or hydraulic systems, pneumatic systems, or mechanical systems coupled with the dies. Wings are attached to the dies in some embodiments.

In at least one embodiment of the press brake, the first and second dies substantially abut one another, being separated only to the extent to enable the first and second dies to be displaced without contacting one another. In another embodiment, an adjustable frame enables the first and second dies to be spaced apart by a desired amount, such that the dies are separated by a gap having a predefined size. The gap enables a channel having a similar size to be formed in a work piece.

Different size and shape dies can be employed. Plate dies coupled with sectors gears or elongate quarter round bars are beneficially employed as dies in some embodiments. Openings in the frame rotatably engage and support the quarter round dies. Sector gears can be coupled with the quarter round dies to control the motion of the dies. Teeth can be formed in the arcuate portion of the quarter round dies to engage rack gears disposed in the frame. The upper surface of the die in contact with the work piece can be shaped to enable over-bending of the work piece.

Yet another aspect of the present invention is a press brake for use in sheet metal forming, to be used in conjunction with a punch forming tool, including a frame and a plurality of rack gears and sectors gears, each rack gear being attached to the frame. The press brake further includes first and second plate dies, each having opposite ends, each end being coupled to a different sector gear. When in operation, a displacement of one of the first and second plate dies results in a corresponding displacement of the other of the first and second plate dies; and a separation between adjacent edges of the first plate die and the second plate die remains substantially constant as the first and the second plate dies are displaced.

Still other aspects of the present invention are directed to methods of forming sheet metal using tools generally corresponding to those described above. One method includes the step of providing a malleable work piece, means to apply a deforming pressure to the work piece, and a tool to support the work piece as a deforming pressure is applied to the work piece. The tool includes movable first and second working surfaces that substantially support the work piece during each phase of the deformation of the work piece. The method also includes the steps of positioning the work piece on the first and second working surfaces of the tool, and applying a deforming pressure to the work piece. When the deforming pressure is applied, the first and second working surfaces of the tool move in response to the deforming pressure to provide support for the work piece, while maintaining a fixed separation between adjacent edges of the first and second working surfaces. Such a method preferably also includes the steps of providing means to apply an opposing force to the work piece and applying an opposing force in a direction opposite to that of the deforming force.

In a related method for forming sheet metal, each die includes an upper surface configured to support a work piece, and each upper surface includes an inner edge and an outer edge. A malleable work piece is placed on the upper surface of the dies, and a deforming pressure is applied to the work piece. The dies move in response to the deforming pressure, but provide substantially continuous support to the work piece. The motion of the dies is such that the inner edge of each die is always closer to the center of rotation for the die than the outer edge. Preferably, the shape of the upper surface of the dies are chosen so that a fixed separation is maintained between the inner edges of the dies, as the dies move. This method also preferably includes the steps of applying an opposing force to the work piece in a direction opposite to that of the deforming force.

Another method for forming a channel in sheet metal uses a press brake, and includes the steps of providing a malleable work piece, applying a deforming pressure to the work piece, applying at least one opposing force to the work piece, and supporting the work piece as the deforming pressure is applied to the work piece. The method provides for substantially supporting the work piece during each phase of its deformation. The method also includes the step of positioning the work piece on the first, second, and third working surfaces of the press brake, such that a gap exists between said first and second working surfaces, and so that the third working surface is disposed within said gap. Then, a deforming pressure is applied to the work piece. The first and second working surfaces of the tool move in response to the deforming pressure to provide support for the work piece, while maintaining a fixed separation between adjacent edges of the first and second working surfaces. At the same time, at least one opposing force is applied in a direction opposite that of the deforming force. The opposing force is applied to the first, second, and third working surfaces of the tool, which in turn apply the opposing force to the work piece. The deforming force, the at least one opposing force, and the first, second, and third working surfaces cooperate to form a channel in the work piece. Preferably, the step of applying an opposing force in a direction opposite to that of the deforming force includes the steps of applying a first opposing force to the first and second working surfaces of the tool, which in turn apply the first opposing force to the work piece, thereby facilitating the deformation of the work piece to form the walls of the channel. A second opposing force is applied to the third working surface of the tool, which in turn applies the second opposing force to the work piece, thereby supporting the portion of the work piece corresponding to the bottom of the channel.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein:

FIG. 2A is a schematic end view of a different type of prior art press brake bottom tool that includes two dies, each shaped like a half cylinder;

FIG. 2B is an isometric view of the prior art press brake die of FIG. 2A;

Figure 1A:
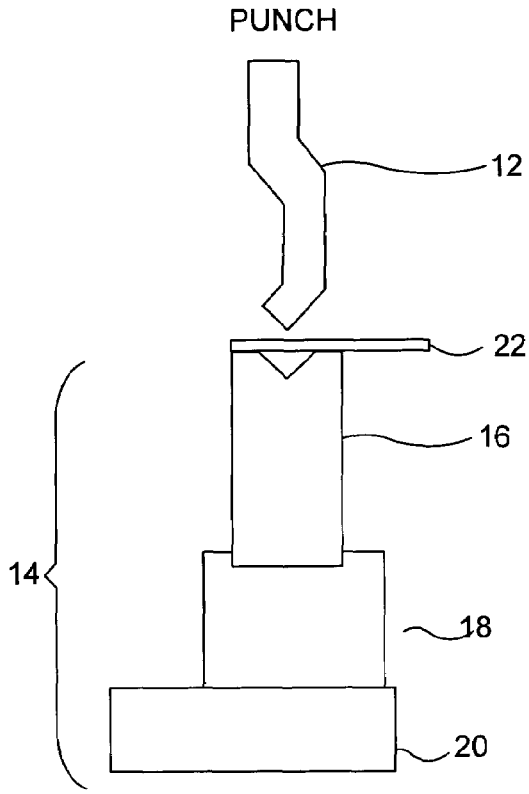
FIG. 1A PRIOR ART
FIG. 1A is a schematic end view of a prior art press brake, with a work piece positioned on a v-shaped die portion of the press brake.
Figure 1B:
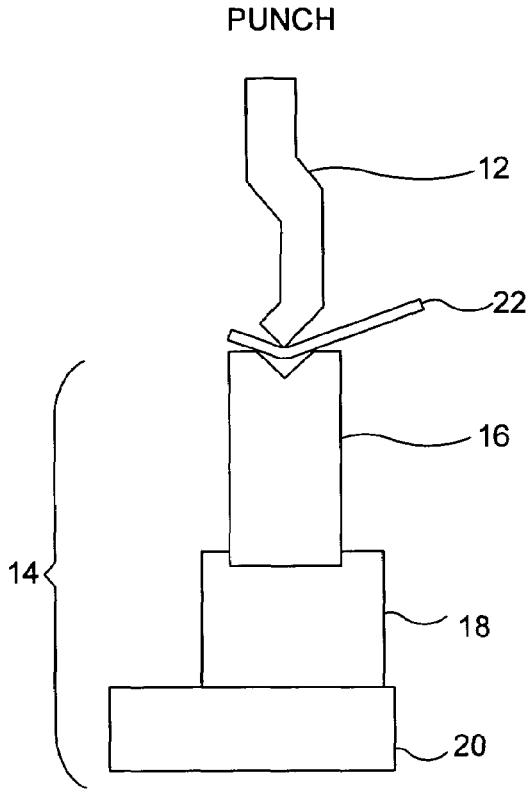
FIG. 1B PRIOR ART
FIG. 1B is a schematic end view of the prior art press brake of FIG. 1A, with punch impacting the work piece, which has begun to deform into an underlying die.
Figure 1C:
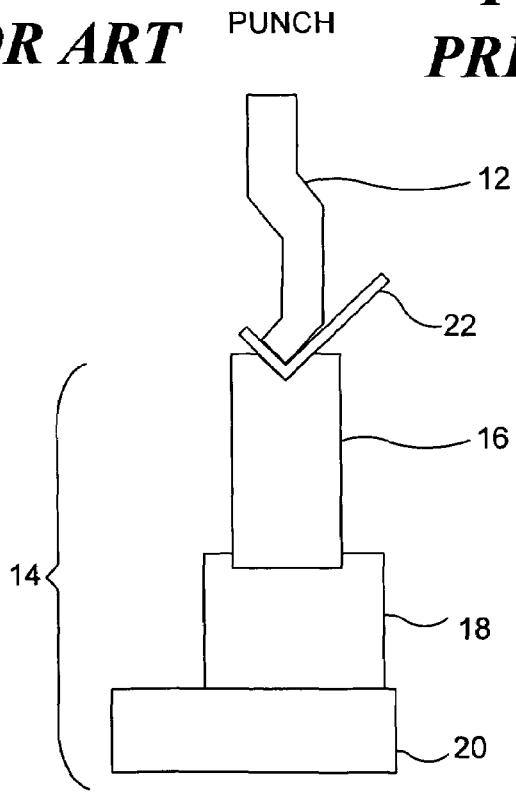
FIG. 1C PRIOR ART
FIG. 1C is a schematic end view of the prior art press brake of FIGS. 1A and 1B, with the punch in the fully extended position, and the work piece deformed according to the shape of the die.
Figure 4:
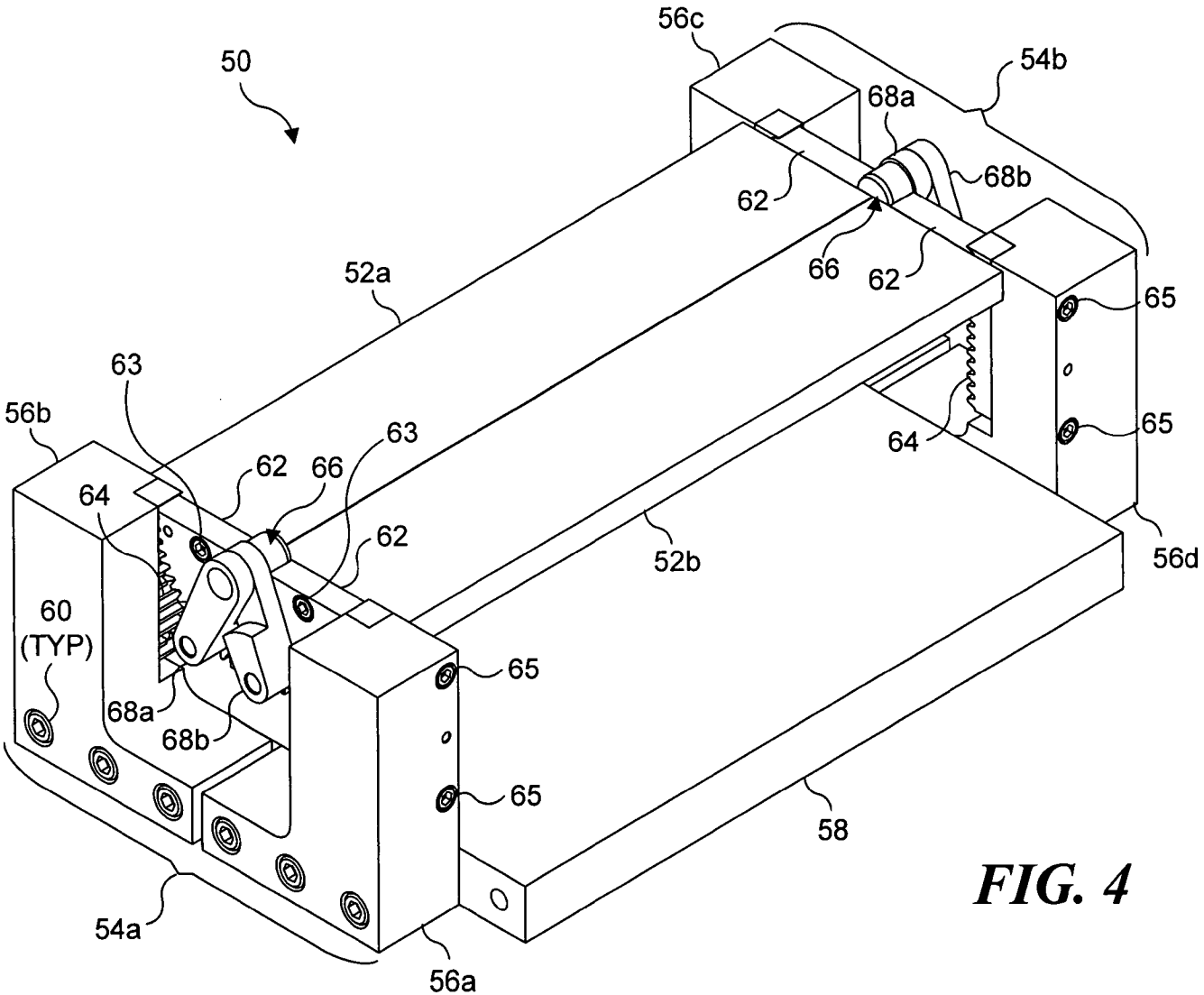
Figure 5:
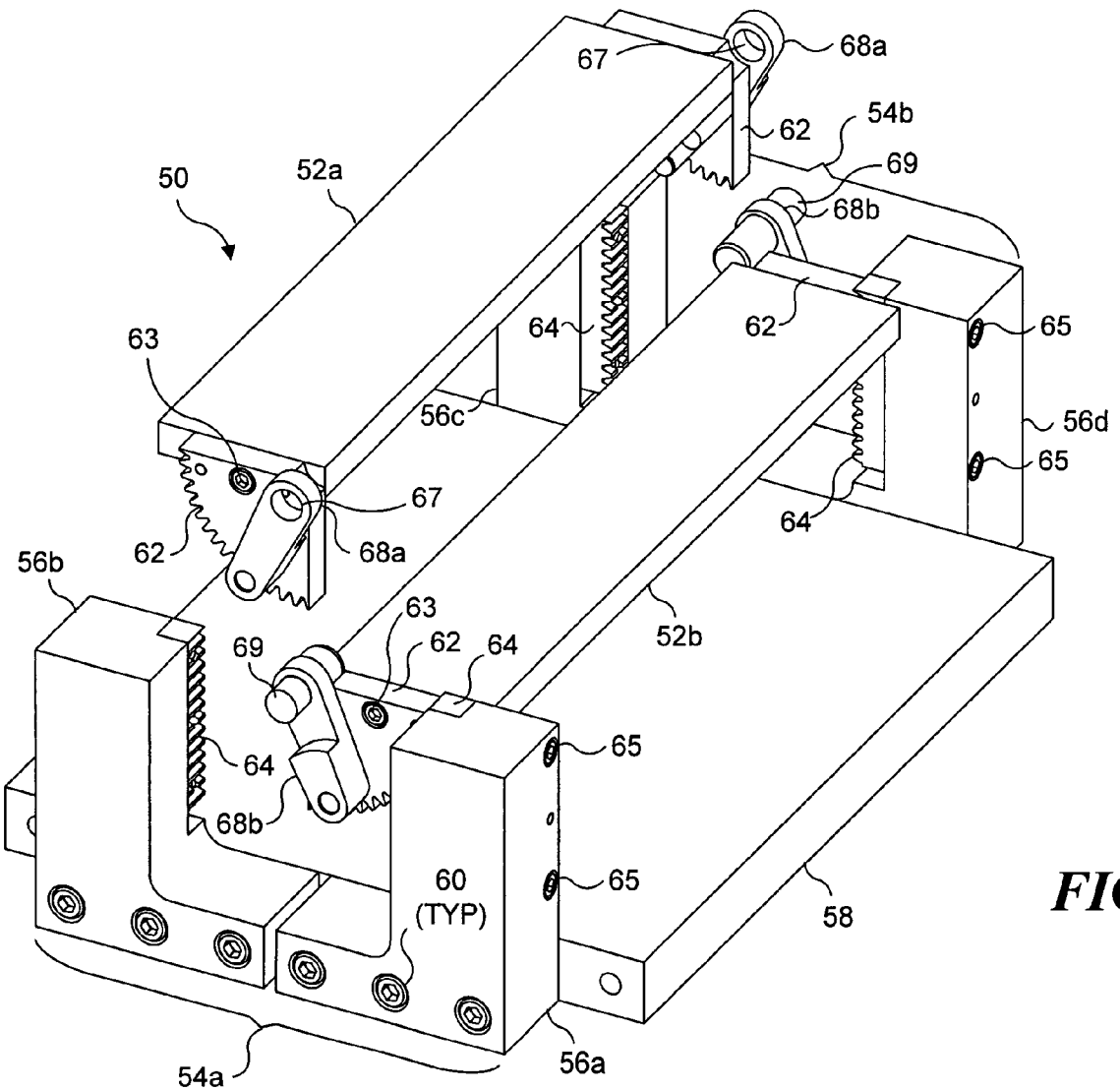
Figure 6:
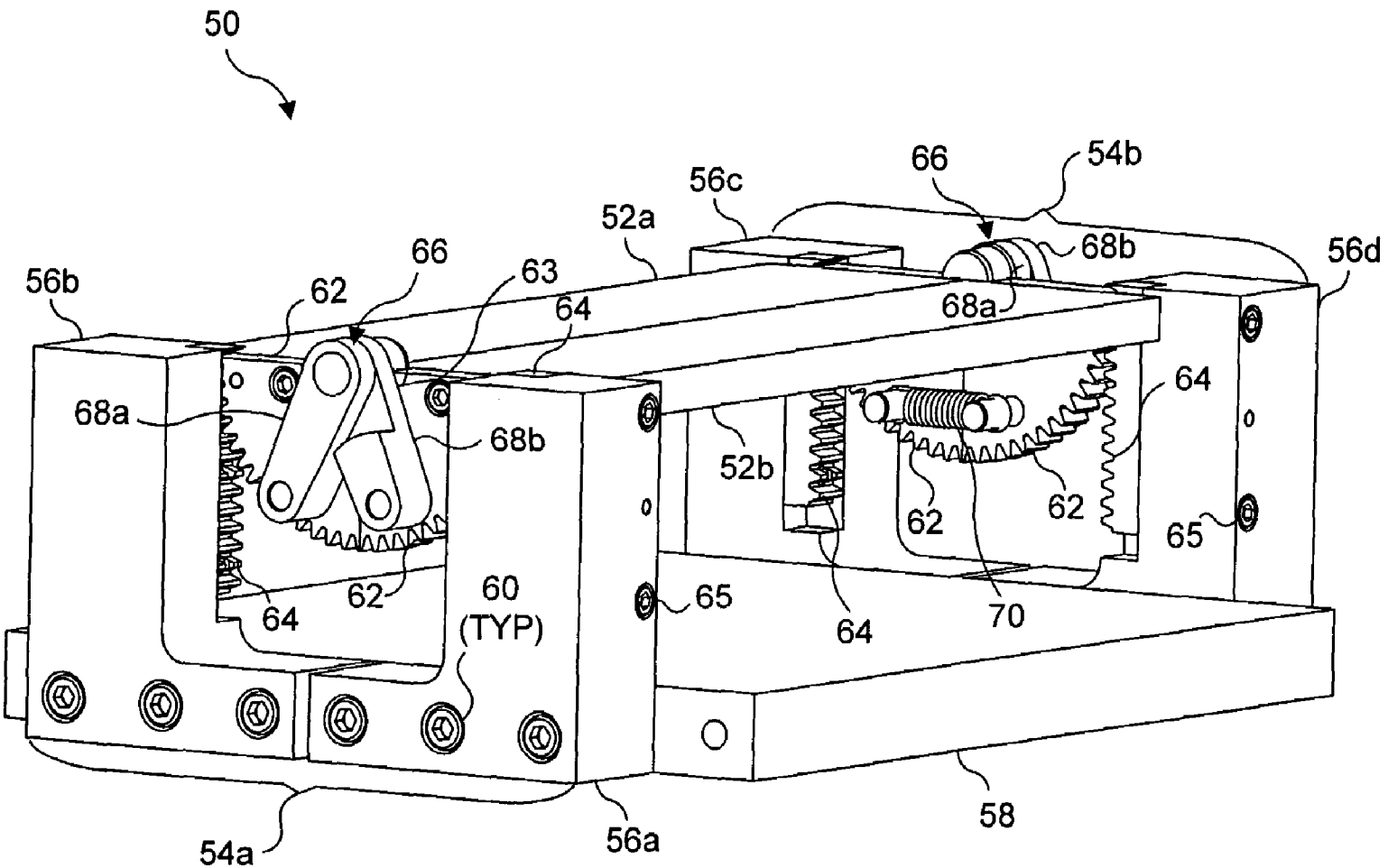
Figure 7A:
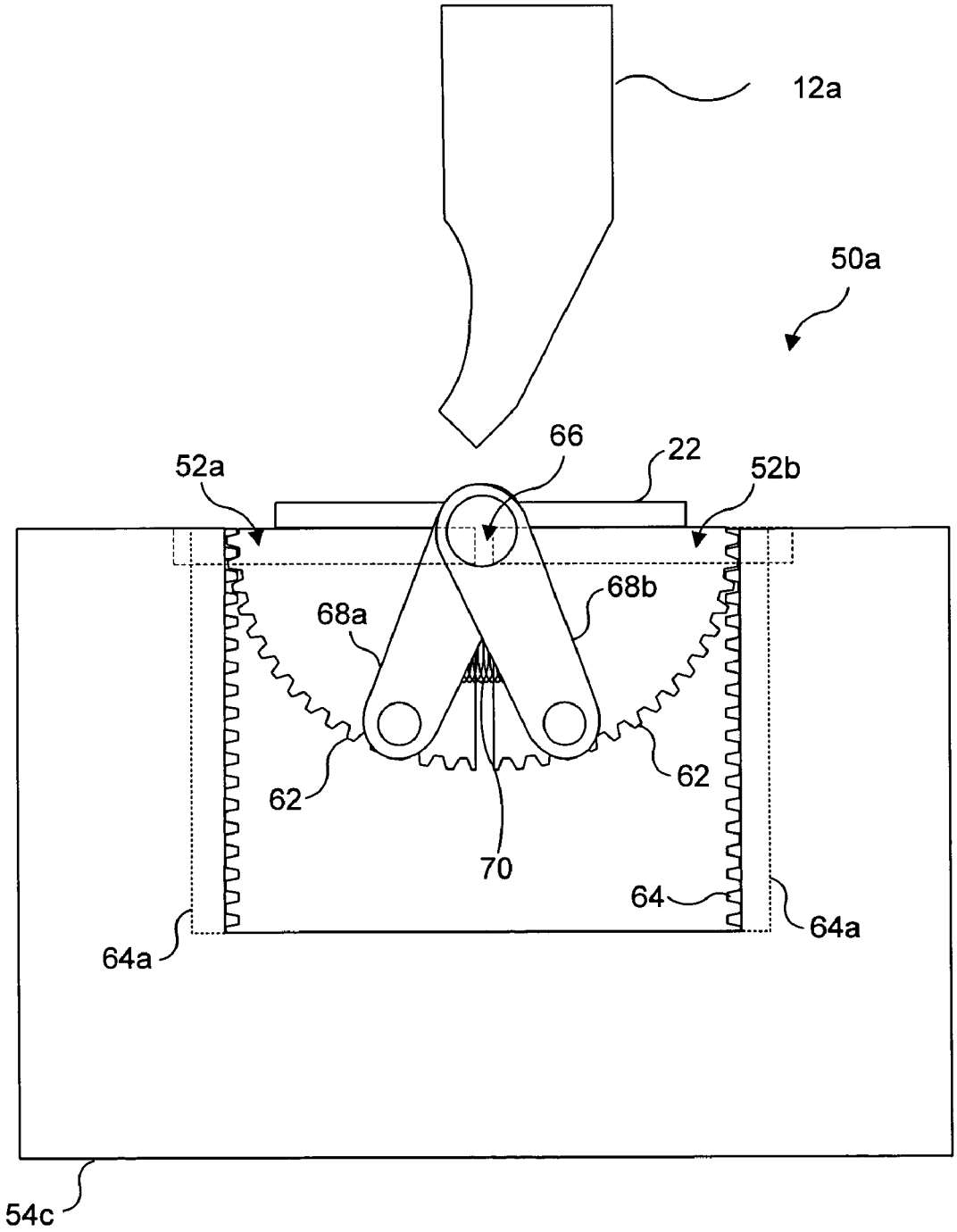
Figure 7B:
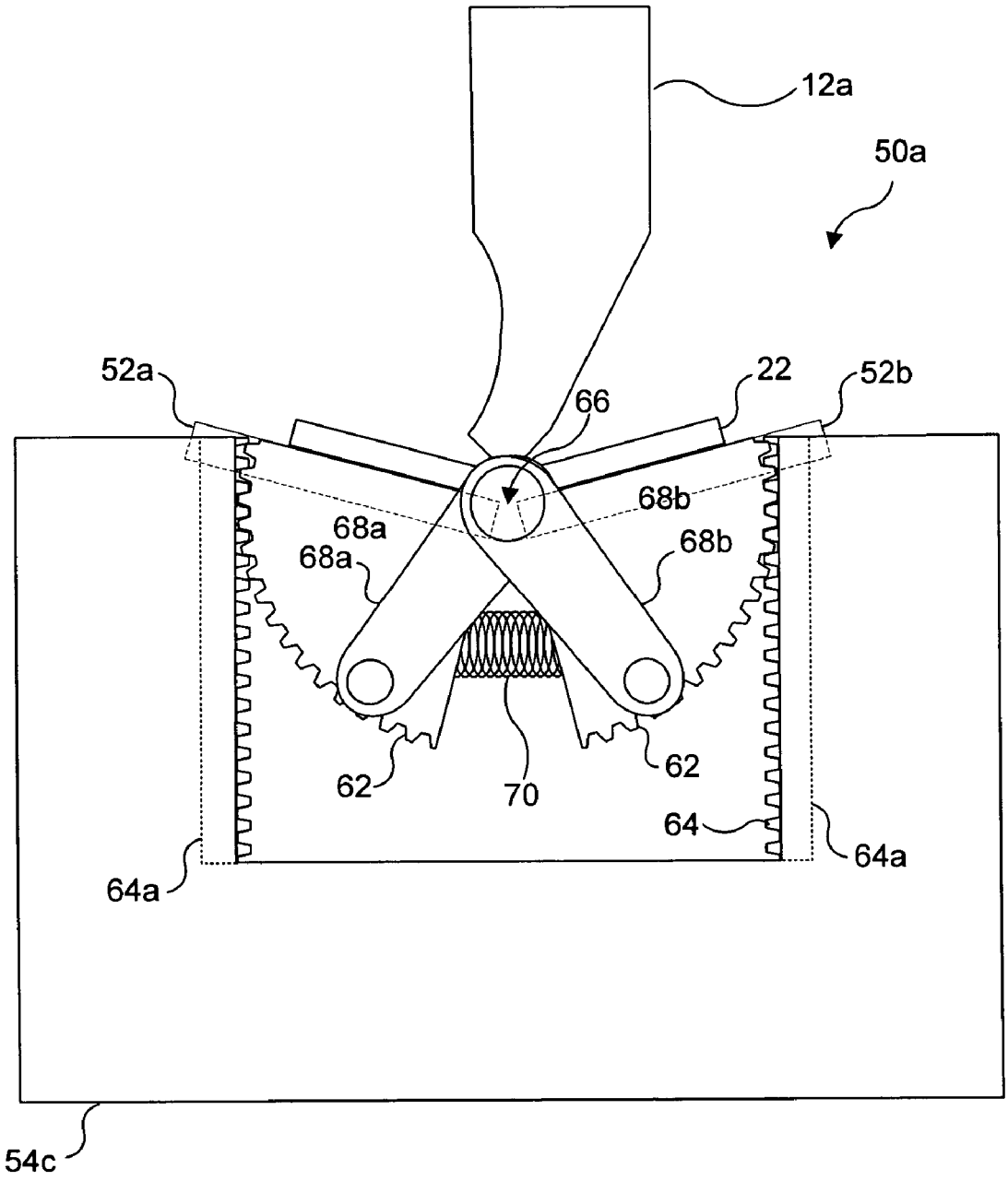
Figure 7C:
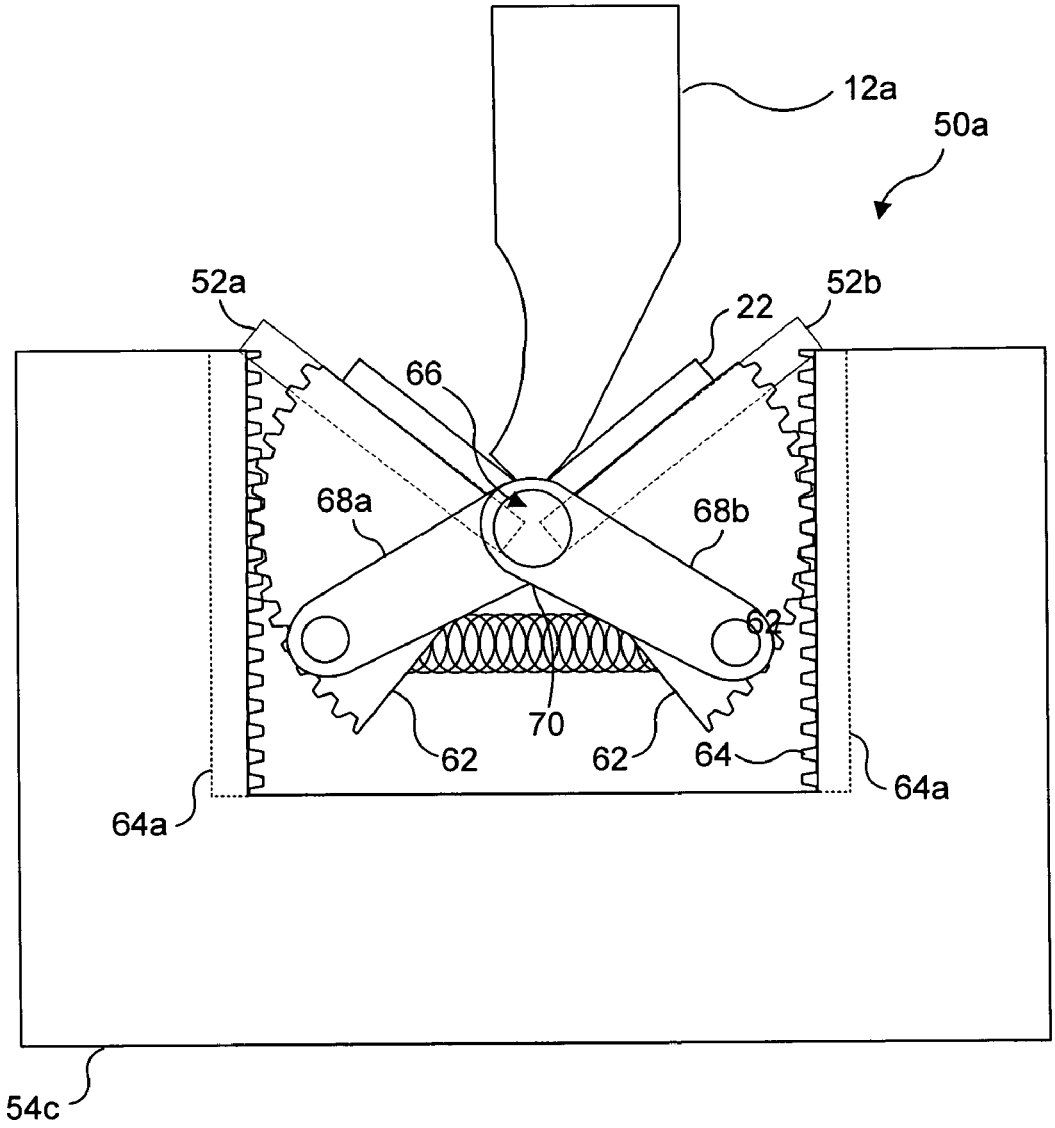
Figure 7D:
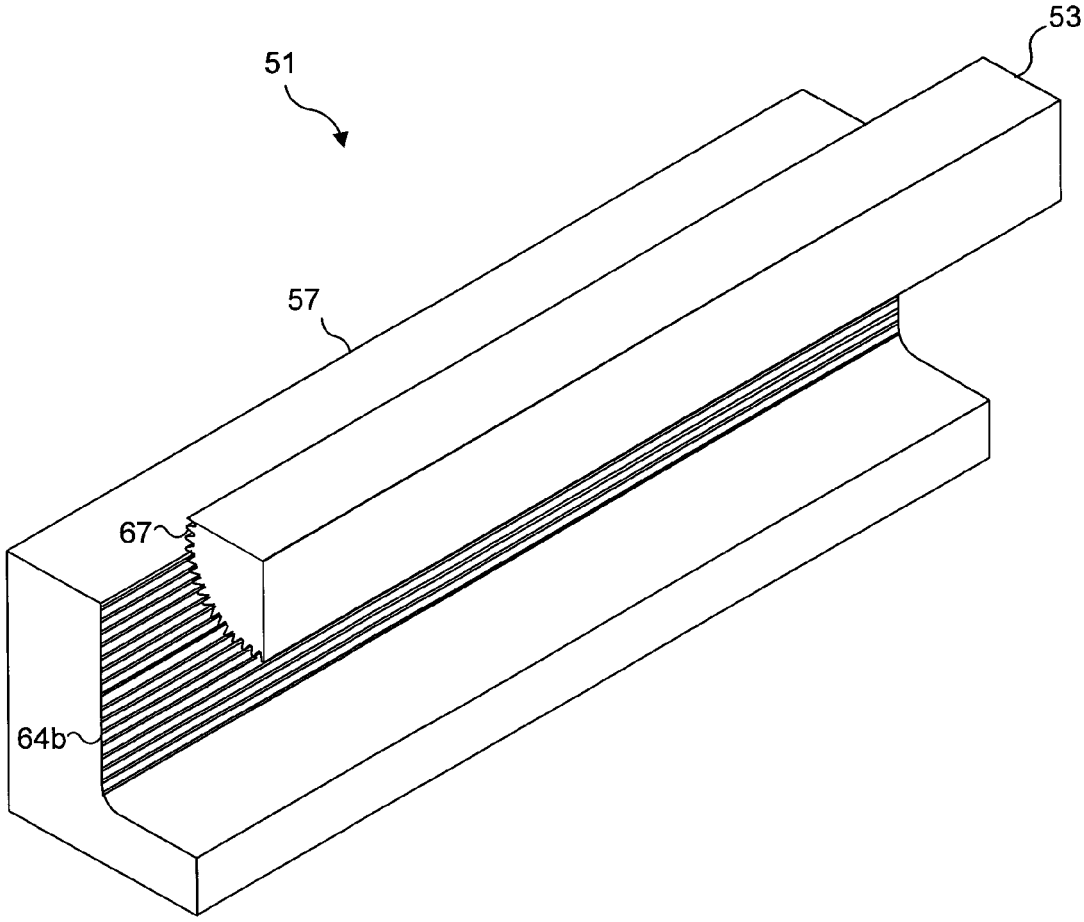
Figure 8A:
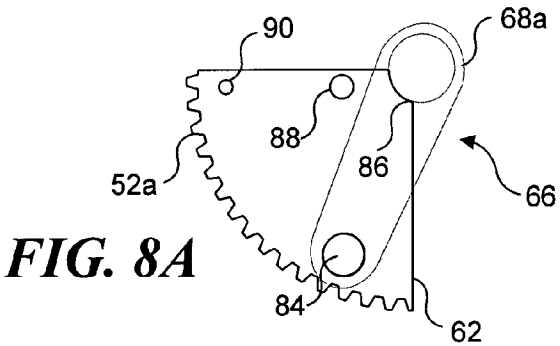
Figure 8B:
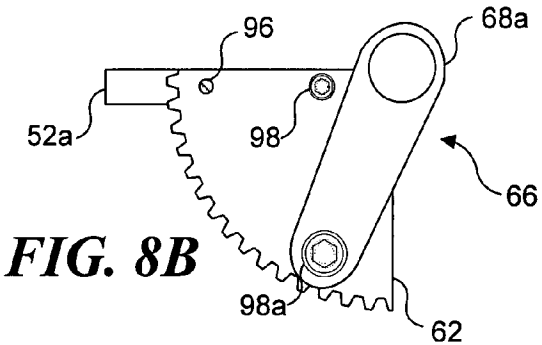
Figure 8C:
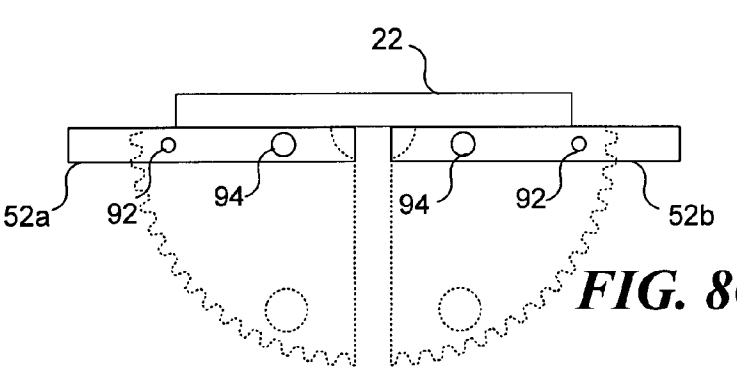
Figure 11A:
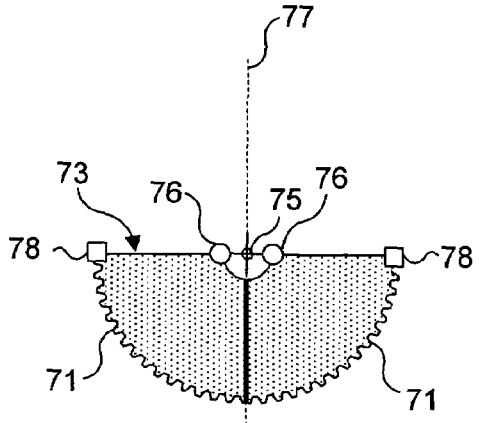
Figure 12A:
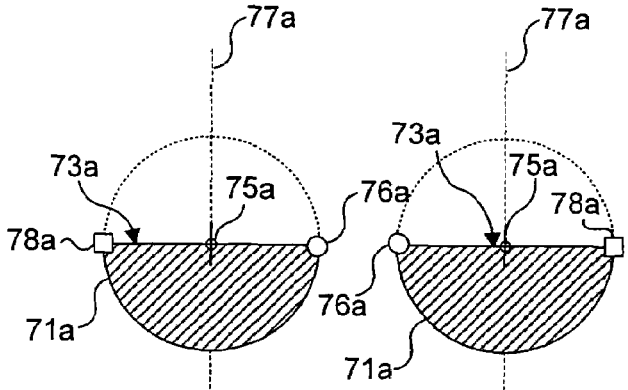
FIG. 12A PRIOR ART
Figure 11B:
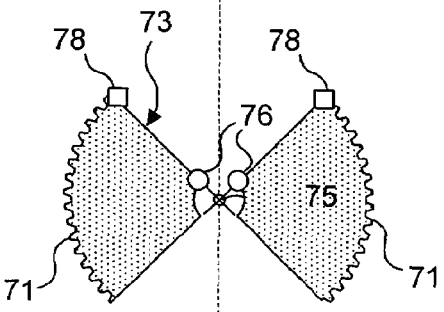
Figure 12B:
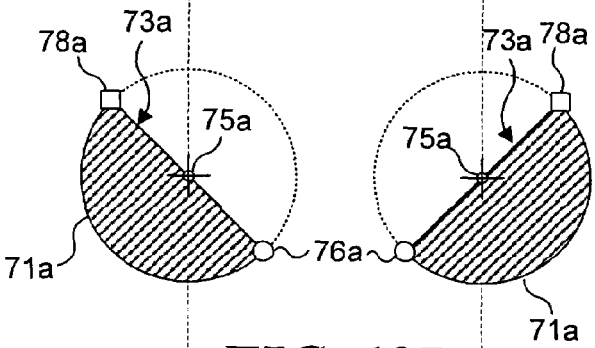
FIG. 12B PRIOR ART
Figure 11C:
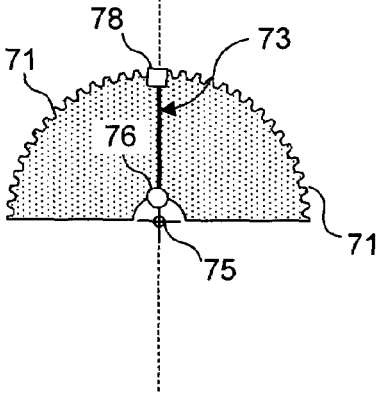
Figure 12C:
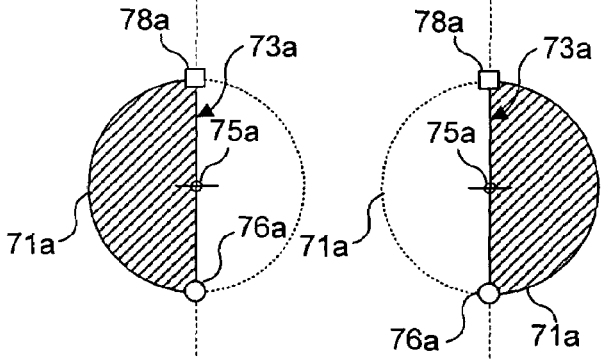
FIG. 12C PRIOR ART
Figure 13A:
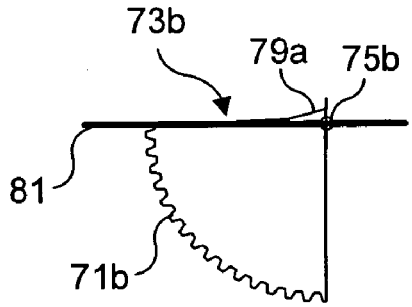
Figure 13B:
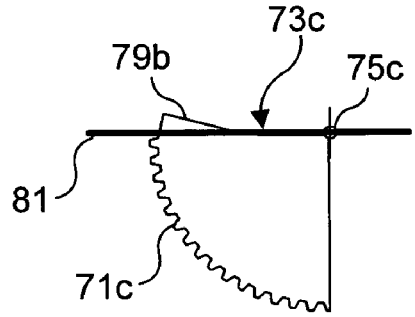
Figure 13C:
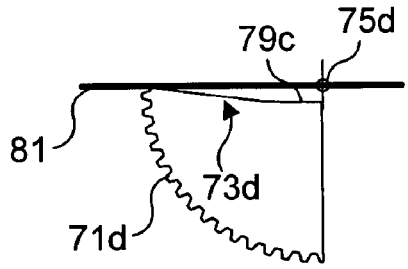
Figure 14A:
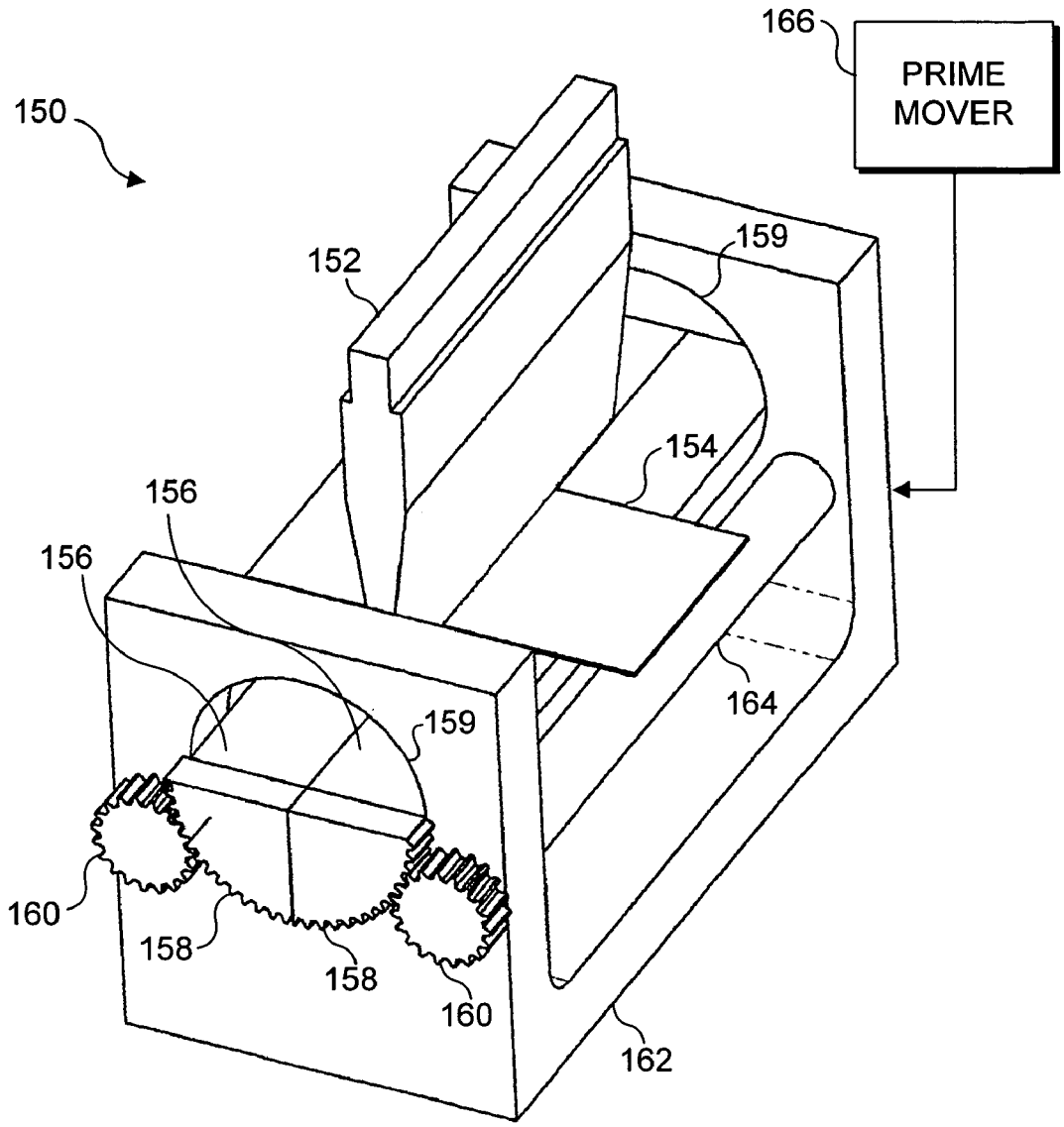
Figure 14B:
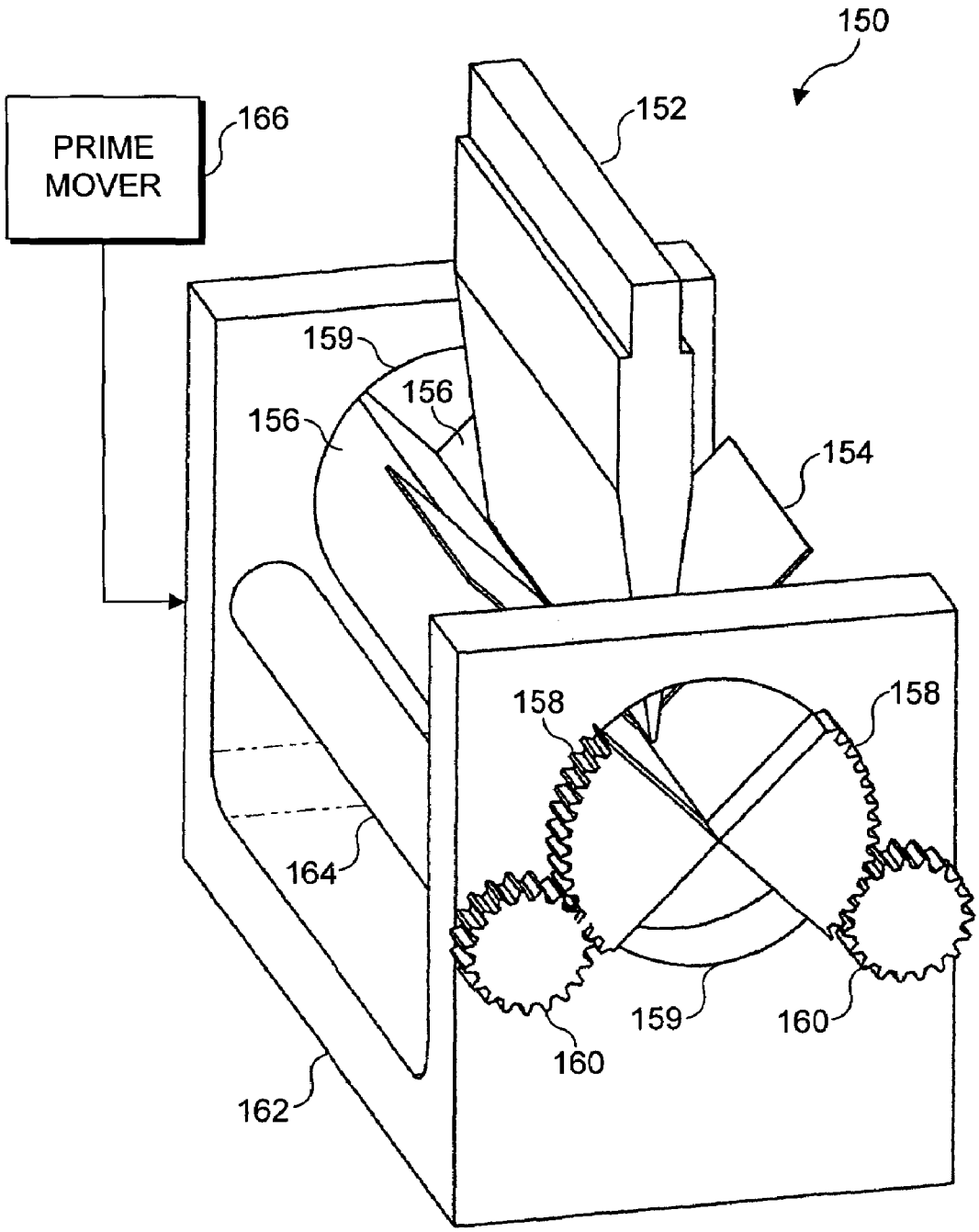
Figure 15A:
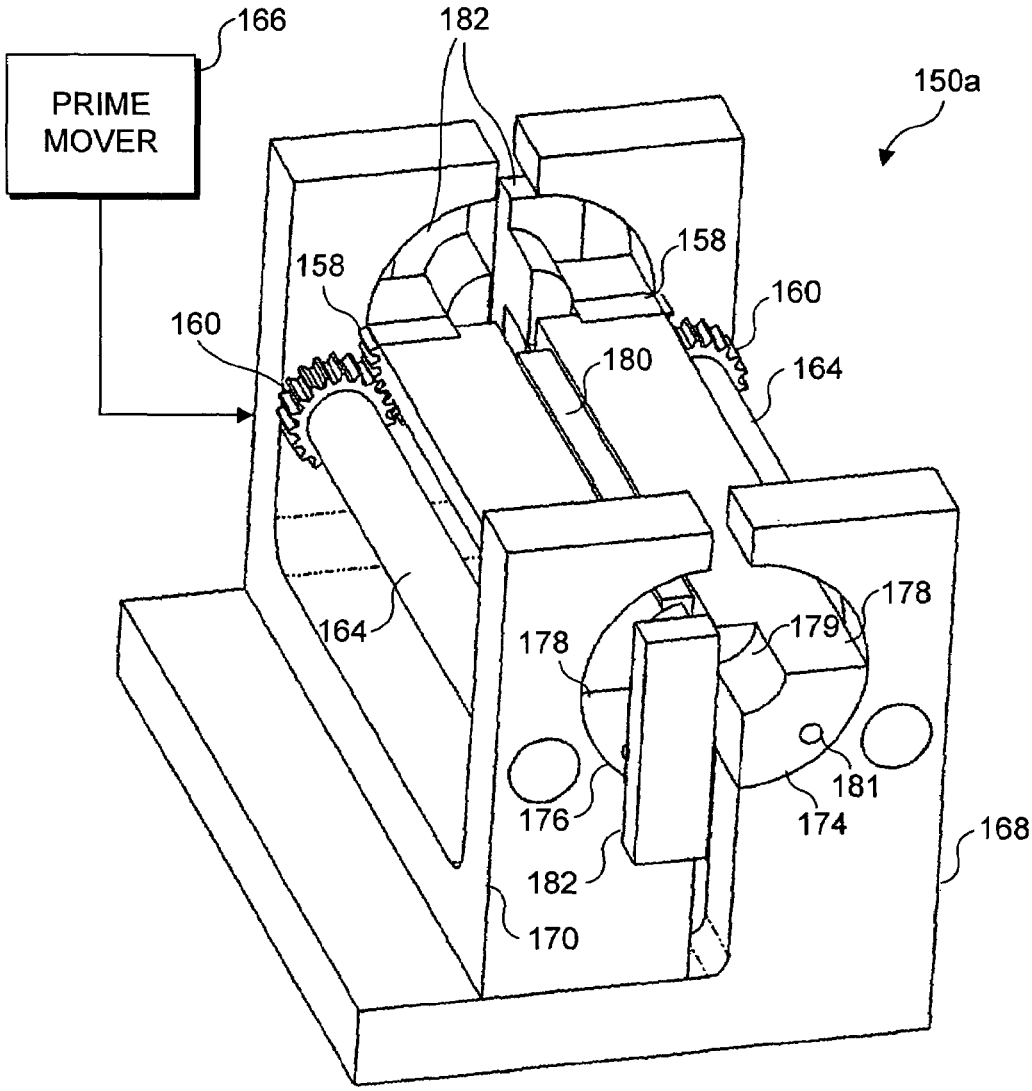
Figure 15B:
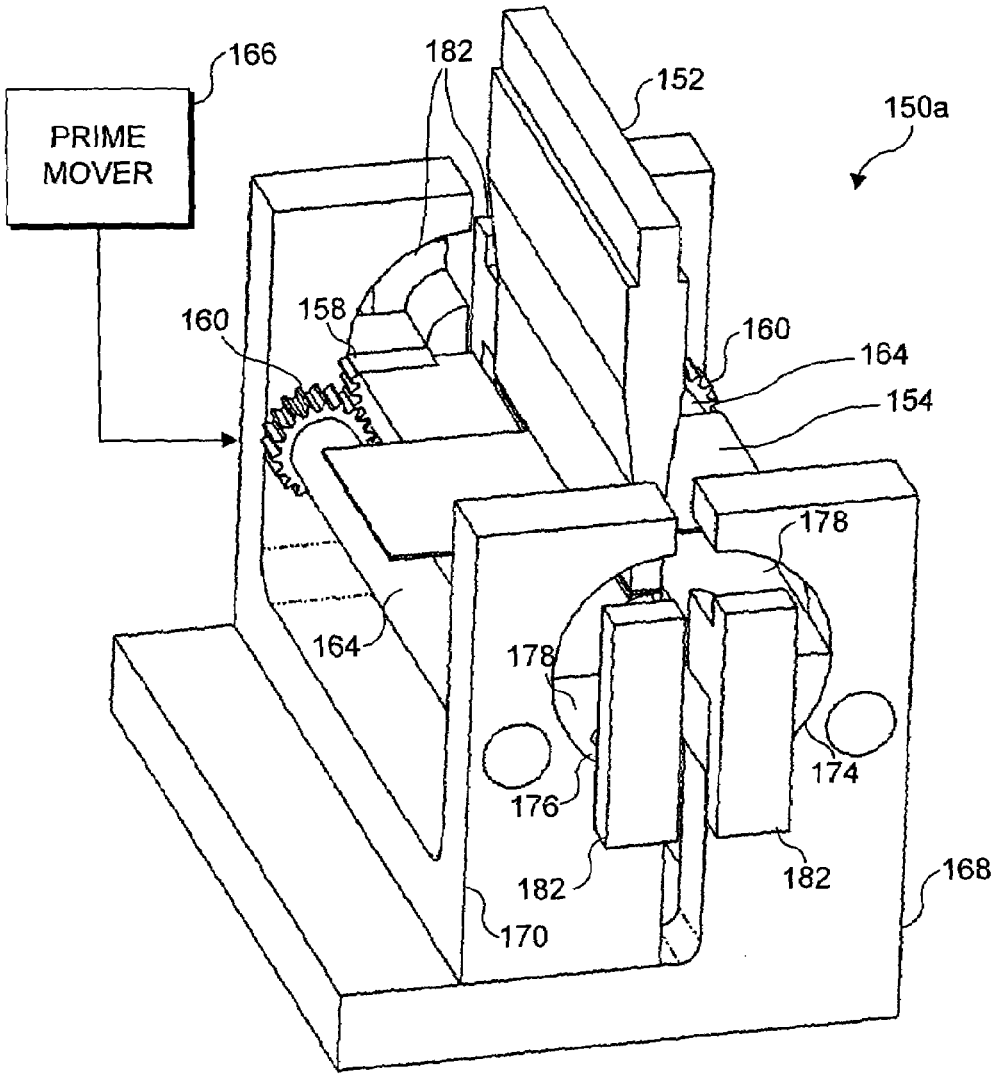
Figure 15C:
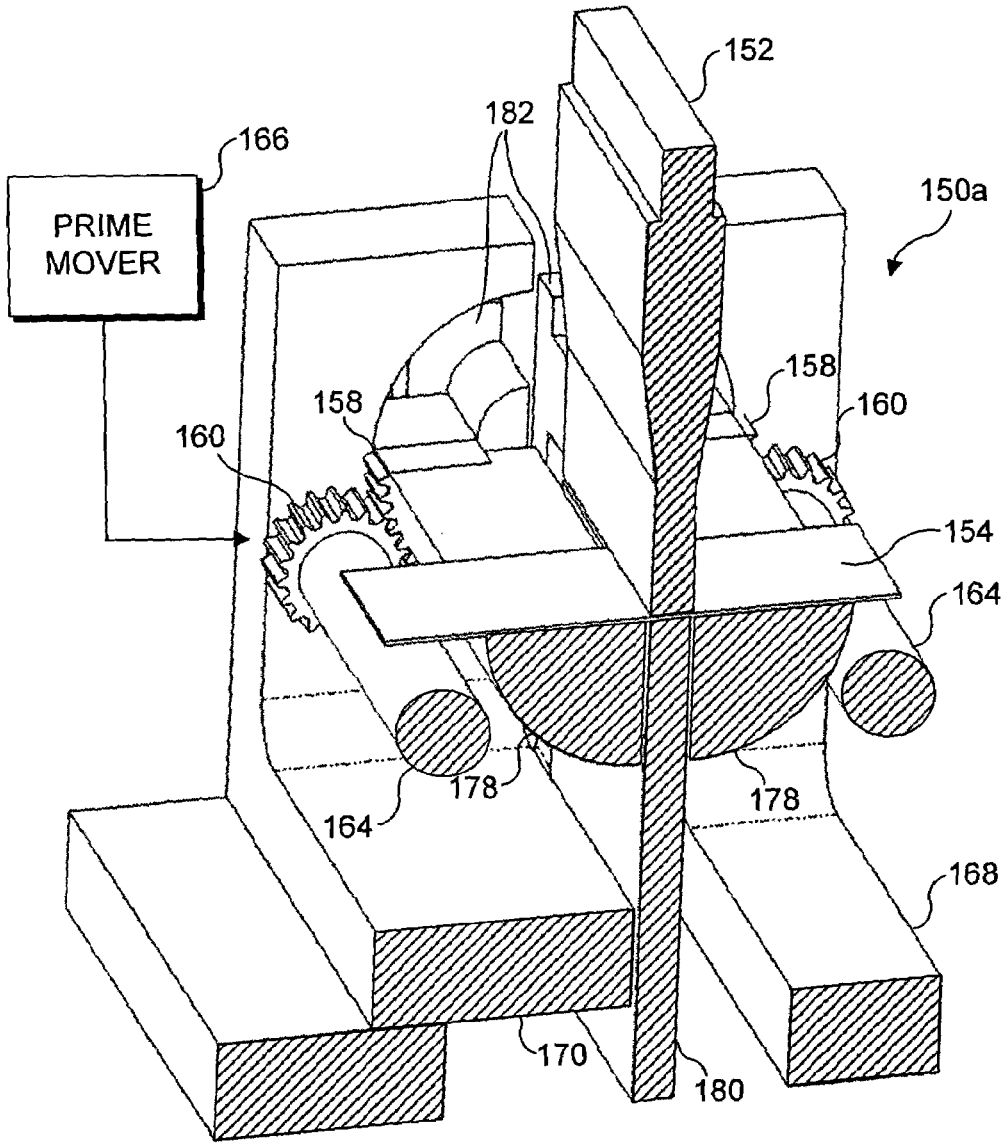
Figure 16:
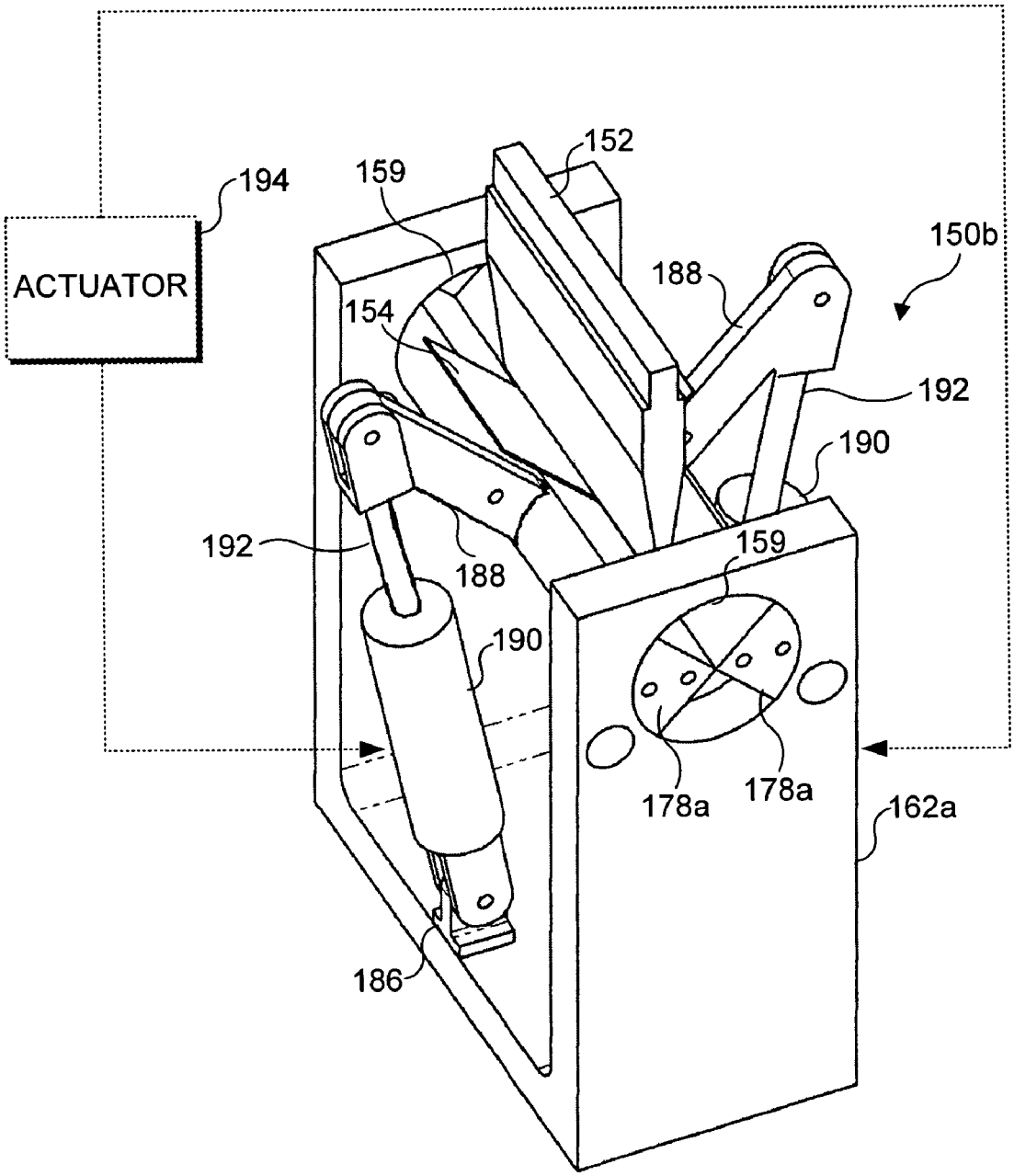
Figure 17A:
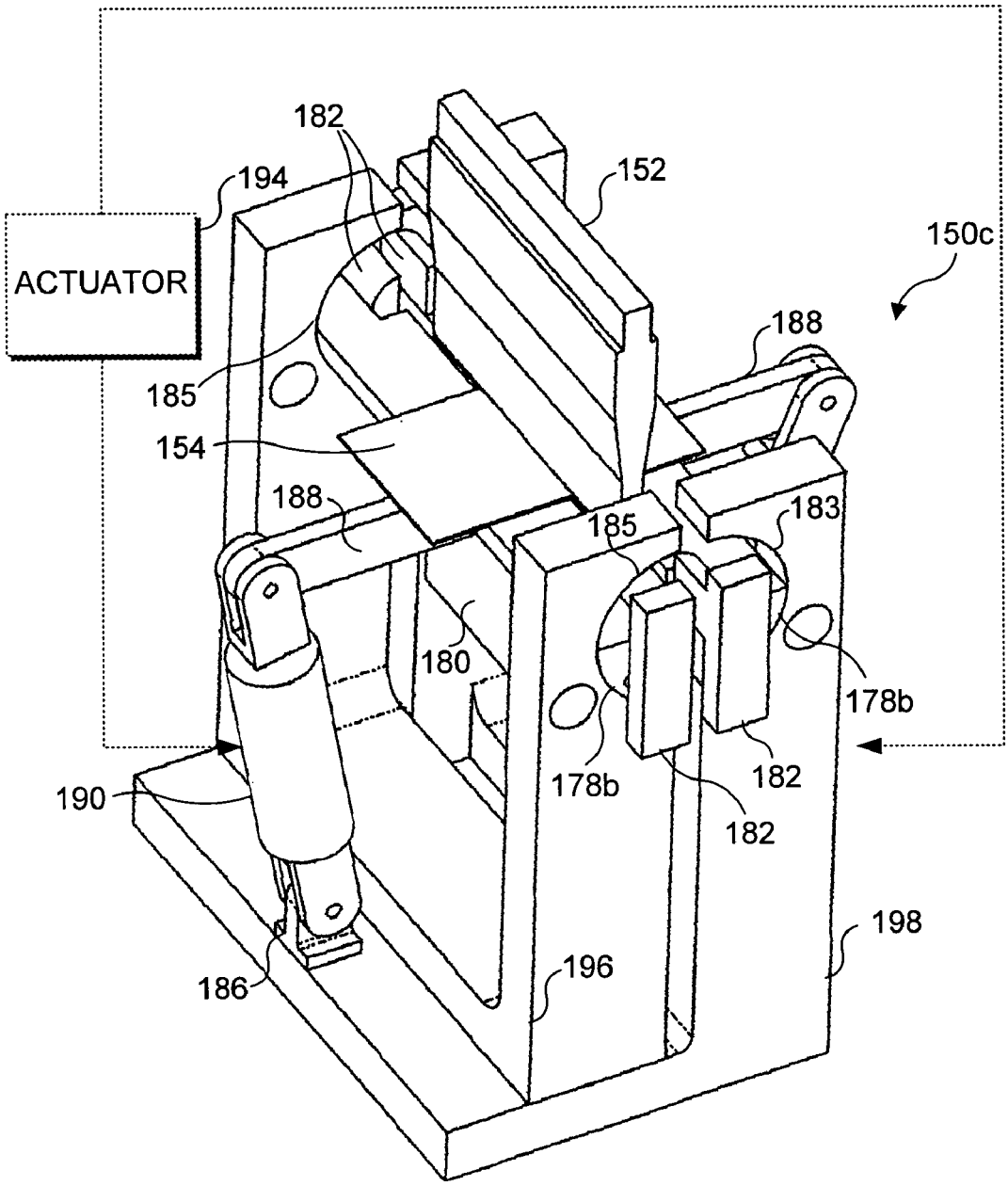
Figure 17B:
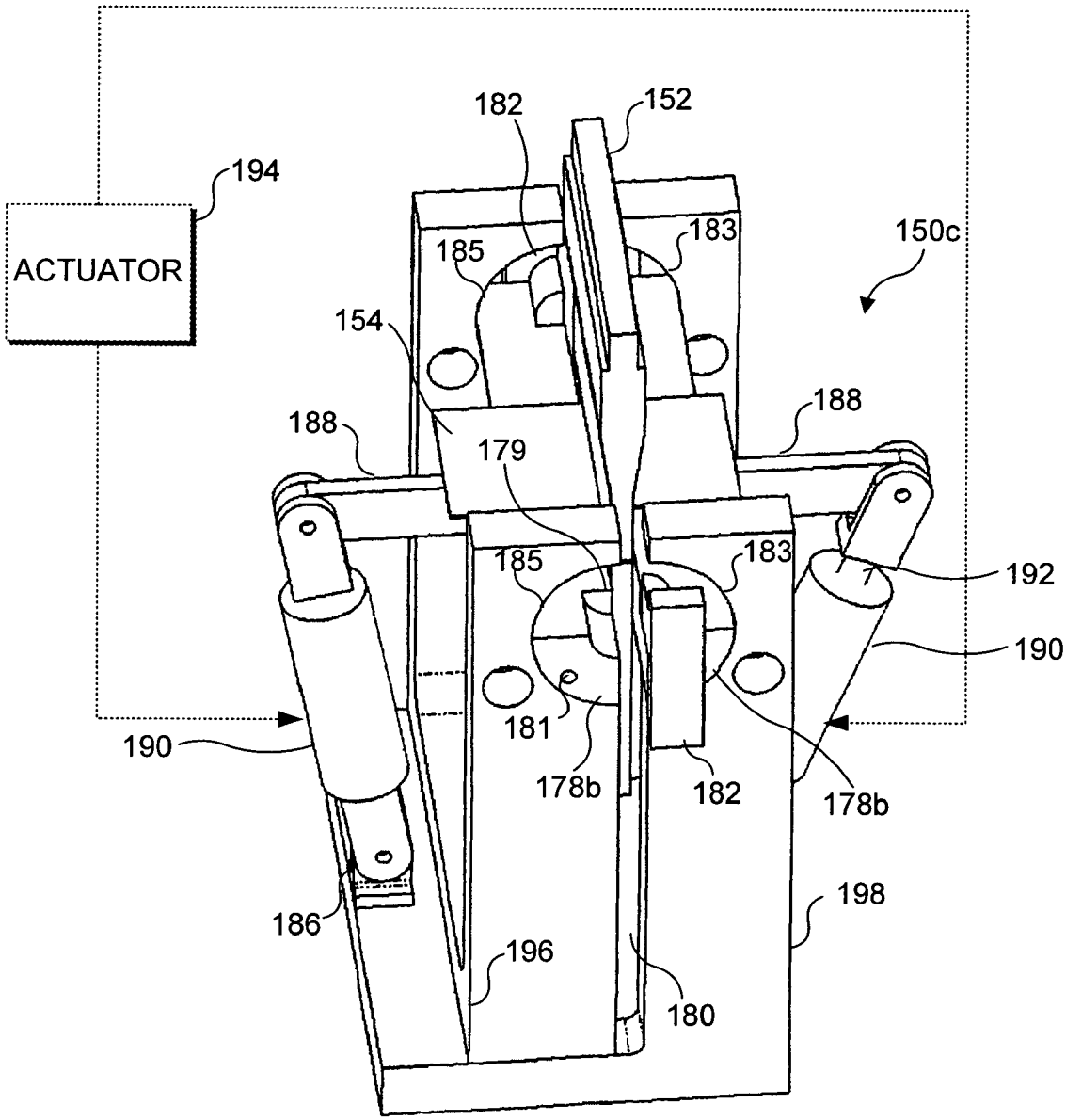
Figure 17C:
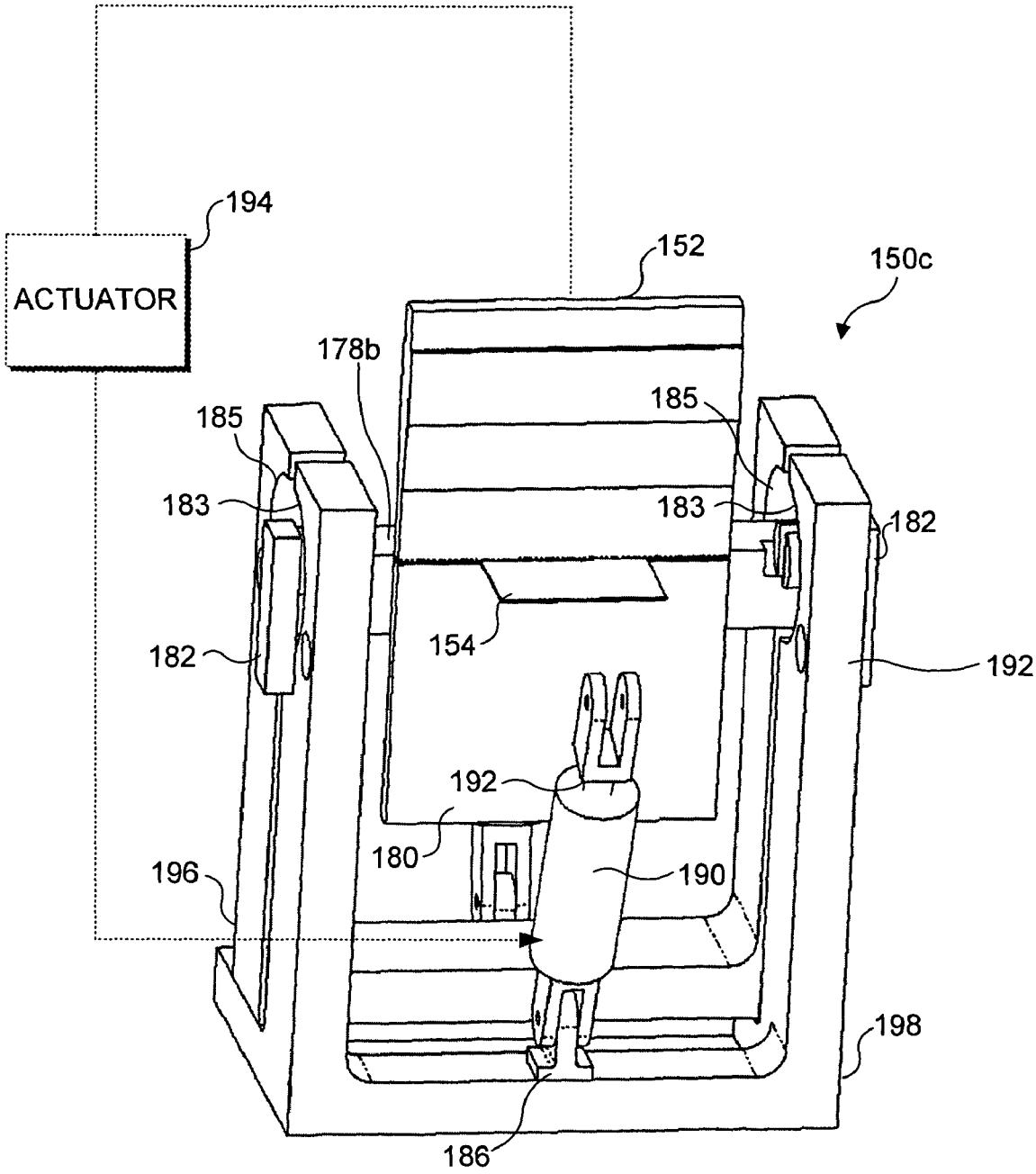

FIG. 2C schematically illustrates a different embodiment of the prior art press brake bottom tool shown in FIGS. 2A and 2B, with a work piece positioned on half-cylinder shaped wing dies, and punch disposed adjacent to the work piece;

FIG. 2D schematically illustrates the prior art press brake wing dies of FIG. 2C, with the punch impacting the work piece, which has begun to deform;

FIG. 2E schematically illustrates the prior art press brake wing dies of FIG. 2C, with the punch in a more fully extended position, and the work piece bent to form an angle of about 90 degrees;

FIG. 3A is a schematic end view of yet another prior art press brake that includes two dies that are also shaped like half cylinders;

FIG. 3B is an isometric view of the prior art press brake of FIG. 3A;

FIG. 3C schematically illustrates the prior art press brake of FIGS. 3A and 3B, with a work piece positioned on the half-cylinder shaped dies, and a punch disposed adjacent to the work piece;

FIG. 3D schematically illustrates the prior art press brake of FIG. 3C, with the punch impacting the work piece, which has begun to deform;

FIG. 3E schematically illustrates the prior art press brake of FIG. 3C, with the punch in a more fully extended position, and the work piece deformed to bend in an angle of about 90 degrees;

FIG. 4 is an isometric view of a first embodiment of the present invention, which employs plate dies and a rack and sector gear mechanism;

FIG. 5 is a partially exploded isometric view of the first embodiment of the present invention of FIG. 4;

FIG. 6 is yet another isometric view of the embodiment shown in FIG. 4, rotated so that the return spring can be clearly seen;

FIG. 7A schematically illustrates a different embodiment of the present invention, with a work piece positioned on the plate dies, and punch disposed adjacent to the work piece;

FIG. 7B schematically illustrates the embodiment of FIG. 7A, with the punch impacting the work piece, which has begun to deform;

FIG. 7C schematically illustrates the embodiment of FIGS. 7A and 7B, with the punch in a more fully extended position, and the work piece deformed in a bend of about 90 degrees;

FIG. 7D schematically illustrates a bracket and die in which a rack and pinion assembly extends substantially along a longitudinal length of the bracket and die;

FIGS. 8A-8C schematically illustrate details of sector gears and plate dies utilized in the embodiment of FIGS. 7A-7C;

FIGS. 9A-9D schematically illustrate details of sector gears and flanged plate dies utilized in yet another embodiment of the present invention, which is particularly well adapted to form a channel in a work piece;

FIGS. 10A-10D schematically illustrate how embodiment that includes the sector gears and flanged plates of FIGS. 9A-9D is employed to form a channel in a work piece;

FIGS. 11A-11C schematically illustrate a die having an inner edge, which remains proximate to a center of rotation as the die is rotated;

FIGS. 12A-12C schematically illustrate how prior art dies do not include an inner edge that remains proximate to a center of rotation regardless of how the die is rotated;

FIGS. 13A-13C schematically illustrate dies that include portions that extend above, or are recessed below, a horizontal plane passing through the center of rotation introduced in FIGS. 11A-11C;

FIGS. 14A and 14B are isometric views of a bottom tool in accord with the present invention, in which the dies are driven to exert a force on a work piece;

FIGS. 15A and 15B are isometric views of another bottom tool in which the dies are driven to exert a force on a work piece and which include a frame that can be adjusted to vary a gap between opposed dies;

FIG. 15C is a cross sectional isometric view of the bottom tool of FIGS. 15A and 15B;

FIG. 16 is an isometric view of a bottom tool in which the dies include wings that are coupled to hydraulic actuators that control the motion of the dies; and FIGS. 17A-17C are isometric views of still another bottom tool in which the dies include wings that are coupled to hydraulics, and which includes a frame that can be adjusted to vary a gap between opposed dies.

DESCRIPTION OF THE PREFERRED EMBODIMENT

An isometric view of a first preferred embodiment of the present invention is illustrated in FIG. 4. Like the prior art press brakes that use wing dies and roller dies as described above in the Background of the Invention, the present invention provides enhanced support for work pieces being deformed. However, the present invention employs a significantly different structure that maintains a fixed separation between the dies as the work piece is being deformed or bent. In at least one embodiment, instead of using dies generally shaped like half of a cylinder disposed in correspondingly shaped channels, the present invention uses less massive dies that are coupled to a rack and sector gear system, enabling a die motion to be achieved that supports the work piece, but maintains a fixed separation between the dies. In addition to plate type dies, other die forms, such as triangular cross sections, quarter round cross sections, and square cross sections, can alternatively be employed. A quarter round die section is particularly advantageous in certain embodiments described in detail below. Particularly where strength of the bottom tool is a requirement, solid quarter round sector gear dies with teeth running the length of the die can be employed in the present invention. As used herein and in the Claims, it will be understood that the terms "bending die" and "bottom tool" are used interchangeably.

Referring now to FIG. 4, a bottom tool 50 is shown that includes a bottom plate 58, and two generally U-shaped brackets 54*a* and 54*b*. In this embodiment, each generally U-shaped bracket is formed of two separate components. Thus U-shaped bracket 54*a* includes a first L-shaped bracket 56*a* and a second L-shaped bracket 56*b*, while U-shaped bracket 54*b* includes a first L-shaped bracket 56*c* and a second L-shaped bracket 56*d*. It should be understood that a single U-shaped bracket could be employed instead of utilizing U-shaped brackets made up of separate components. Generally U-shaped brackets 54*a* and 54*b* are attached to bottom plate 58 using conventional fasteners. As illustrated, recessed set screws 60 have been used to removably attach the generally U-shaped brackets to bottom plate 58. It should be understood that other types of fasteners could alternatively be utilized for this purpose.

Bottom tool 50 preferably includes two plate-type dies 52*a* and 52*b*. Each plate die is attached to two sector gears 62 with fasteners 63. Each sector gear is substantially one-quarter of a circular gear. Each sector gear 62 engages one of four racks 64 that are respectively mounted on the four L-shaped brackets with fasteners 65. Thus, each generally L-shaped bracket 56*a*-56*d* includes a separate rack 64, which engages a different sector gear 62. A hinge assembly 66 couples the two sector gears 62 that are disposed at the same end of bottom tool 50. Thus, one hinge assembly couples the sector gears disposed adjacent U-shaped bracket 54*a*, and another hinge assembly couples the sector gears that are disposed adjacent to U-shaped bracket 54*b*. Each hinge assembly includes an arm 68*a* coupled to one sector gear 62, and an arm 68*b* coupled to the other sector gear disposed at the same end of bottom tool 50. The hinge assemblies are not required, particularly if the tool will be utilized only for bending thin material.

As will be described in greater detail below, a gap between the two dies can be adjusted by moving the separate components of the U-shaped brackets apart. In embodiments where the generally U-shaped brackets are formed as single components, such a gap cannot be adjusted. Thus, while single piece U-shaped brackets could be employed in place of the pairs of L-shaped brackets, use of such single component brackets will affect this functionality of the tool.

In the exploded view of FIG. 5, the racks 64 that are mounted on the L-shaped brackets are more readily visible. Note that each generally L-shaped bracket 56*a*-56*d* is notched so that racks 64 can be readily mounted on the generally L-shaped brackets. As shown, a plurality of fasteners 65 are provided to removably fasten the racks to the generally L-shaped brackets. FIG. 5 also enables the relative thicknesses of each plate 52*a* and 52*b* to be clearly illustrated. Note how much less material is required for each plate 52*a* and 52*b*, compared to the generally half-cylinder shaped dies illustrated in FIGS. 2A-2E and FIGS. 3A-3E. Particularly when the die is fabricated from a hardened material, a bottom tool that employs less massive dies requires considerably less hardened steel than the half-cylinder shaped dies employed in the prior art, and is therefore less expensive. FIG. 5 also illustrates additional details of hinge arms 68*a* and 68*b*. Each hinge arm includes an orifice 67 in the upper portion of the arm that receives a shaft 69 extending out of the upper portion of hinge arm 68*b*. Also note that each hinge arm 68*a* and 68*b* is relieved (i.e., has a portion overlapping the other hinge arm cut away) to enable the hinge arms to fit flush against each other.

FIG. 6 is yet another isometric view of bottom tool 50. In this view, bottom tool 50 has been rotated so that a spring 70 can be seen. Spring 70 is attached at one end to one of sector gears 62 and the other end of spring 70 is attached to the other sector gear. The two sector gears 62 that are connected by each spring 70 are at the same end of bottom tool 50. While the second spring cannot be seen, it will be understood that the second spring similarly connects sector gears 62, which are disposed at the opposite end of bottom tool 50. As will be clear with respect to the following Figures, when bottom tool 50 is used to deform a malleable work piece, plate dies 52*a* and 52*b* are deflected to pivot downwardly under a force applied from above by an upper tool or punch. Spring elements 70 will cause sector gears 62 and plates 52*a* and 52*b* to be returned to their original positions after the downward force applied by the upper tool is removed. Depending on the strength of the springs employed, the springs can also provide a resist force, as is desirable for bending certain materials.

FIGS. 7A-7C illustrate metal forming steps using a bottom tool 50*a*. Bottom tool 50*a* is generally identical to bottom tool 50 described in FIGS. 4-6, except that the generally U-shaped brackets 54*a* and 54*b* of bottom tool 50 are fabricated from pairs of L-shaped brackets, while in bottom tool 50*a*, each generally U-shaped bracket 54*c* is fabricated as a single component. Note that FIGS. 7A-7C represent end views of bottom tool 50*a*, so that only a single generally U-shaped bracket is shown, the U-shaped bracket that is disposed at the opposite end of the tool not being visible in these illustrations. It will be understood, however, that bottom tool 50*a* has a generally U-shaped bracket disposed at each end of the bottom tool.

Referring now to FIG. 7A, spring 70 is illustrated applying a force on each sector gear 62, causing the sector gears to remain in an undeflected or rest position. Dash lines 64*a* indicate the portions of racks 64 that are recessed into U-shaped bracket 54*c*. The racks are disposed so that each sector gear 62 engages a different rack 64. Plate dies 52*a* and 52*b* are also shown in phantom view. It will be understood that work piece 22 is actually resting on the top surfaces of plate dies 52*a* and 52*b*, rather than on sector gears 62. While punch 12*a* is shown in FIGS. 7A-7C, it should be understood that other types of upper tools can be employed to apply a force to work pieces resting on bottom tool 50*a*.

In FIG. 7B, upper tool 12*a* has impacted work piece 22 and is applying a downward pressure, causing plates 52*a* and 52*b* to be deflected downwardly. Each sector gear 62 is thus caused to be move downwardly along its corresponding rack 64, because the sector gears are attached to plates 52*a* and 52*b*. Spring 70 stretches as the sector gears rotate, such that when punch 12*a* is removed, a force applied by spring 70 causes the sector gears to rotate back along their respective racks, so that plates 52*a* and 52*b* return to their undeflected positions.

Referring now FIG. 7C, spring 70 has expanded to an even greater extent, and work piece 22 has been formed or bent into approximately a 90 degree angle. Plates 52*a* and 52*b* have been deflected downwardly enough that the ends of plates 52*a* and 52*b* can be seen extending past bracket 54*c*. Again, once punch 12*a* is withdrawn upwardly and work piece 22 is removed, the force applied by spring 70 will cause sector gear 62 and plate dies 52*a* and 52*b* to return to their original undeflected positions.

Bottom tool 50 of FIGS. 4-6 included pairs of L-shaped brackets to form each U-shaped bracket, while bottom tool 50*a* of FIGS. 7A-7C employs integrally formed U-shaped brackets 54*c*. The use of separate L-shaped brackets provides an advantage, because it enables the dimension of the U-shaped bracket to be adjusted. The dimensions of the U-shaped brackets must be matched to the dimensions of the sector gears. As noted above in the Background of the Invention section, prior art bending brakes enable dies to be removed and replaced with dies of differing size and shape, to provide additional flexibility in the form of the bend produced in a work piece. In the present invention, the L-shaped brackets are preferably removably attached to bottom plate 58 as shown, so that the dimensions of the U-shaped bracket, and thus the dimensions of the sector gears, can be changed to modify the form of the bend produced in a work piece. Larger dies require larger sector gears, in turn requiring correspondingly sized U-shaped brackets, or U-shaped brackets that can be adjusted.

As illustrated, bottom tool 50 of FIGS. 4-6 includes two U-shaped brackets disposed at each longitudinal end of the tool. While FIGS. 7A-7C schematically show front views of bottom tool 50*a* (thus only a single U-shaped bracket is visible), it should be understood that bottom tool 50*a* also includes two U-shaped brackets disposed at each longitudinal end of the tool. It should be noted that it is contemplated that bottom tools in accord with the present invention will be scalable. Thus, a bottom tool including plate dies and rack and sector gear systems can be made of such a length that one or more additional intermediate supports will be required along the longitudinal axis of the tool. Preferably, such additional supports will also include rack and sector gears. Because hinges are not required, the intermediate supports are not necessary. Bottom tools are contemplated in which the rack and sector gear systems run the length of the bottom tool, so that additional supports are not required. FIG. 7D schematically illustrates a bracket and die combination 51 to be used in such a bottom tool. A rack portion 64*b* of a bracket 57 extends along substantially the entire longitudinal length of bracket 57. Instead of separate sector gears and dies, teeth 67 extend substantially along the entire longitudinal length of a die 53. Die 53 is shown offset from bracket 57 to enable rack portion 64*b* to more readily be viewed.

FIGS. 8A-8C provide additional detail relating to the sector gears and plate dies of bottom tools 50 and 50*a*. As indicated in FIG. 8A, each sector gear 62 preferably includes a cutout 86, having a quarter-round shape and sized to support hinge assembly 66. An opening 84 enables the arm of hinge assembly 66 to be securely fastened to the sector gear. Openings 88 and 90 are provided for attaching the sector gear to the plate die (i.e., plate 52*a* or 52*b*). It is contemplated that opening 88 will be sized to accommodate a threaded fastener, while opening 90 will be sized to accommodate a pin on the plate die. It should be understood that other types of fasteners (and/or pins) could be used to securely attach the sector gears to the plate dies in bottom tools 50 and 50*a*.

FIG. 8B shows plate 52*a* attached to sector gear 62 using a threaded fastener 98 and a pin 96, which are inserted into the corresponding openings in sector gear 62. Preferably, the opening in the plate accommodating the threaded fastener will also be threaded. The pivot of hinge assembly 66 is engaged with cutout 86 (which is obscured from view by hinge assembly 66, and is located as illustrated in FIG. 8A), and another threaded fastener 98*a* is used to attach hinge arm 68*a* to sector gear 62. While opening 84 in sector gear 62 could be threaded to accommodate threaded fastener 98*a*, because sector gears 62 are not required to be particularly thick, it is likely that a nut (not visible because the nut is attached to opposite side of the sector gear) will be employed along with threaded fastener 98*a*, to attach the hinge arm to the sector gear.

FIG. 8C shows plates 52*a* and 52*b* supporting a work piece 22, and sector gears 62 are shown in phantom view. Each plate includes openings 92 and 94, corresponding to openings 88 and 90 in each sector gear 62, such that the threaded fasteners and pins noted above may be inserted into each plate.

Figure 9A:
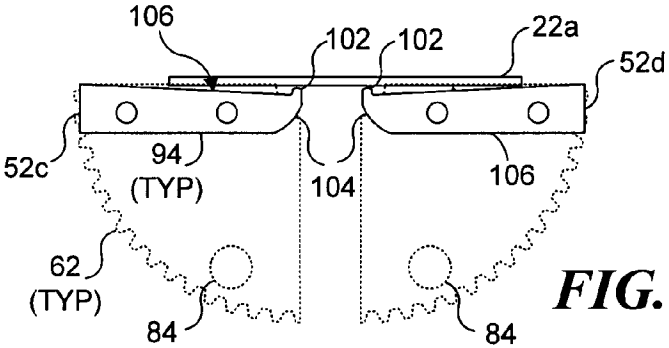

FIG. 9A is similar to FIG. 8C, with plates 52*a* and 52*b* having been replaced with flanged plates 52*c* and 52*d*. As will be discussed in greater detail below, flanged plates 52*c* and 52*d* are employed in a bottom tool 50*b* (schematically illustrated in FIGS. 10A-10D) that is adapted to form channels in a work piece. Generally, bottom tool 50*b* will be used to form relatively thin work pieces, so that work piece 22*a* is thinner than work piece 22. As those of ordinary skill in the art will appreciate, the thickness of a work piece that can be manipulated with the present embodiment is largely dependent on the forces that can be applied to form the work piece. Each flanged plate includes openings 94 to enable the flanged plates to be attached to sector gears as described above. While each flanged plate is shown as including two openings 94 to accommodate threaded fasteners, it should be understood that the flanged plates could also, or alternatively, include openings 92 to accommodate pins 96, as do plates 52*a* and 52*b*. The number and type of fasteners employed to attach a sector gear to the plates of bottoms tools 50, 50*a* and 50*b* are not critical, as long as the fasteners employed securely couple the plates to the sector gears. Flanged plates 52*c* and 52*d* are identical and preferably have sector gears fastened to opposite ends of the flanged plates.

Significant features of each flanged plate are flange tips 102, shoulders 104, and angled surfaces 106. Work piece 22*a* is not fully supported by the entire upper surface of each flanged plate. Instead, work piece 22*a* contacts each flanged plate at flange tip 102, and, if the work piece is long enough, also along the angled upper surface of the flanged plate. If the work piece were not substantially wider than the gap separating the opposed flanged plates, the work piece would only be supported by flange tips 102. The functions of shoulders 104 and angled surfaces 106 will be made clear in FIGS. 10A-10C, and the related text that describes those Figures. Simply stated, shoulders 104 and angled surfaces 106 enable bottom tool 50*b* to accommodate a range of motion required to form a channel in work piece 22*a*.

Figure 9C:
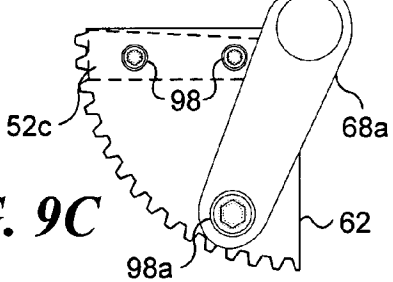
Figure 9D:
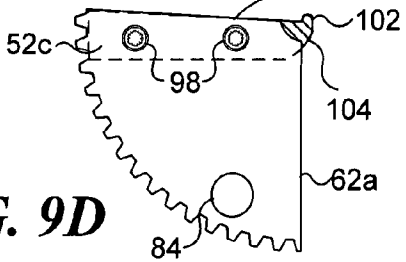
Figure 9B:
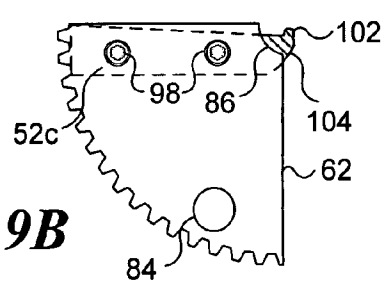
Figure 10A:
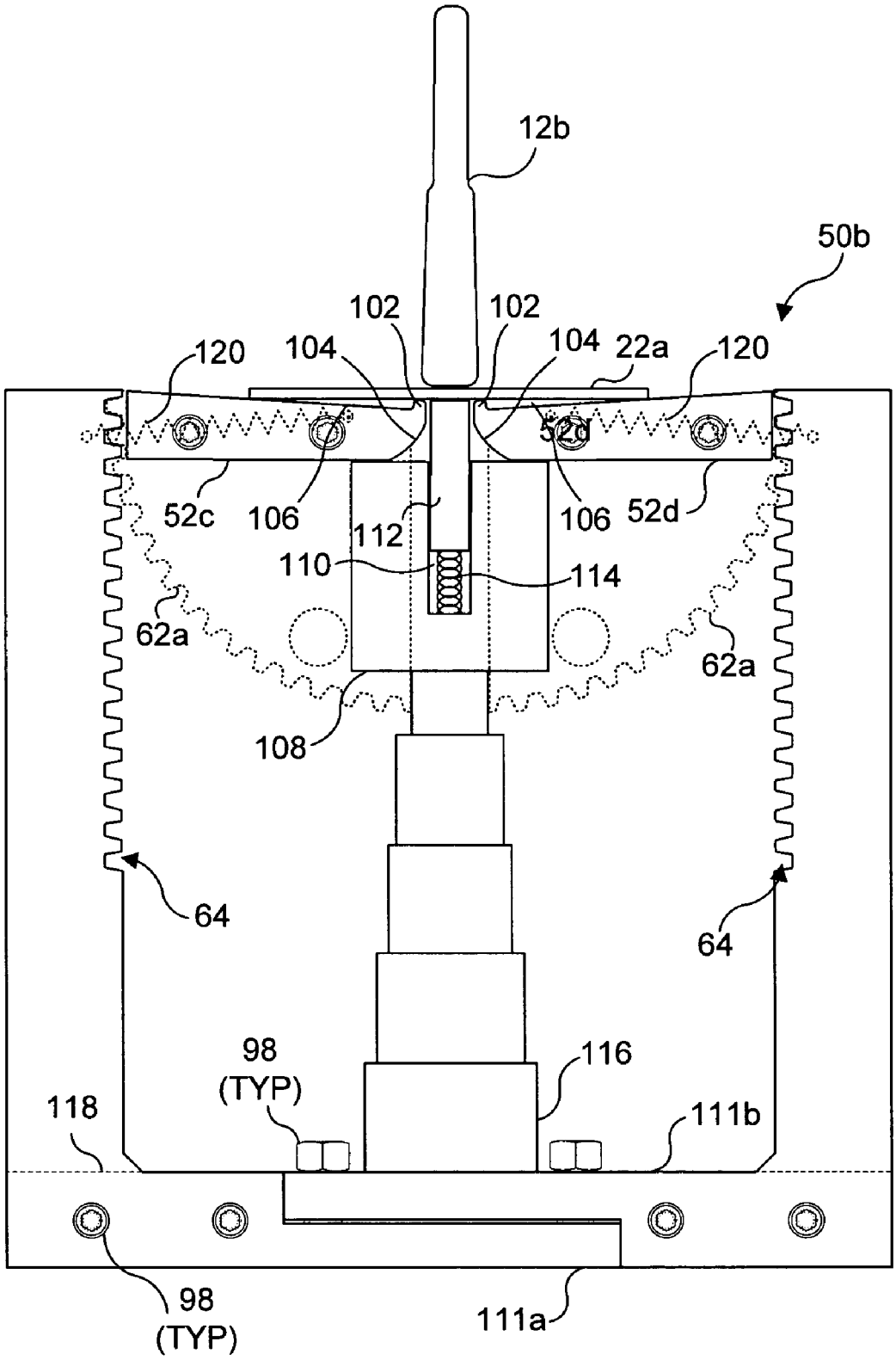
Figure 10B:
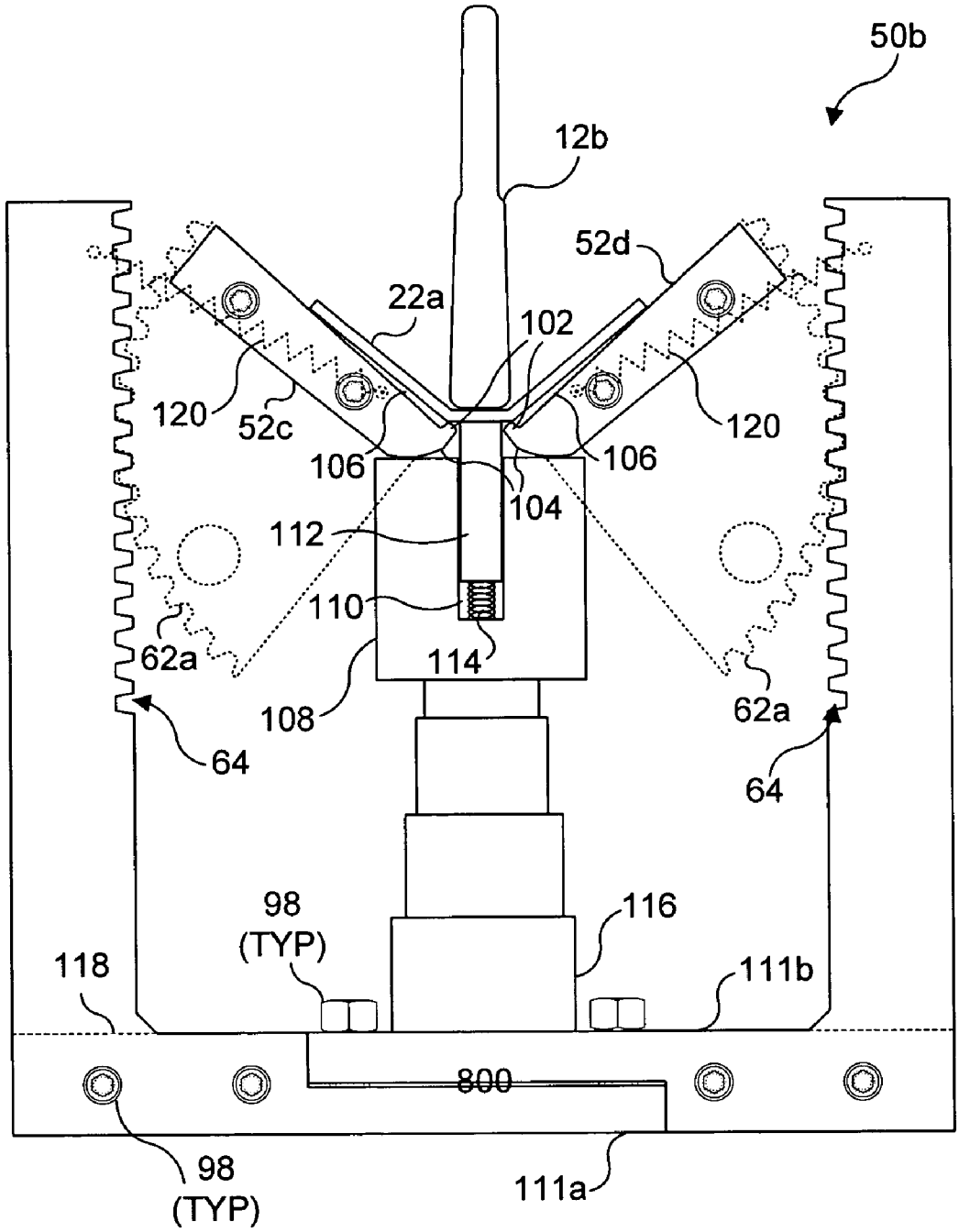
Figure 10C:
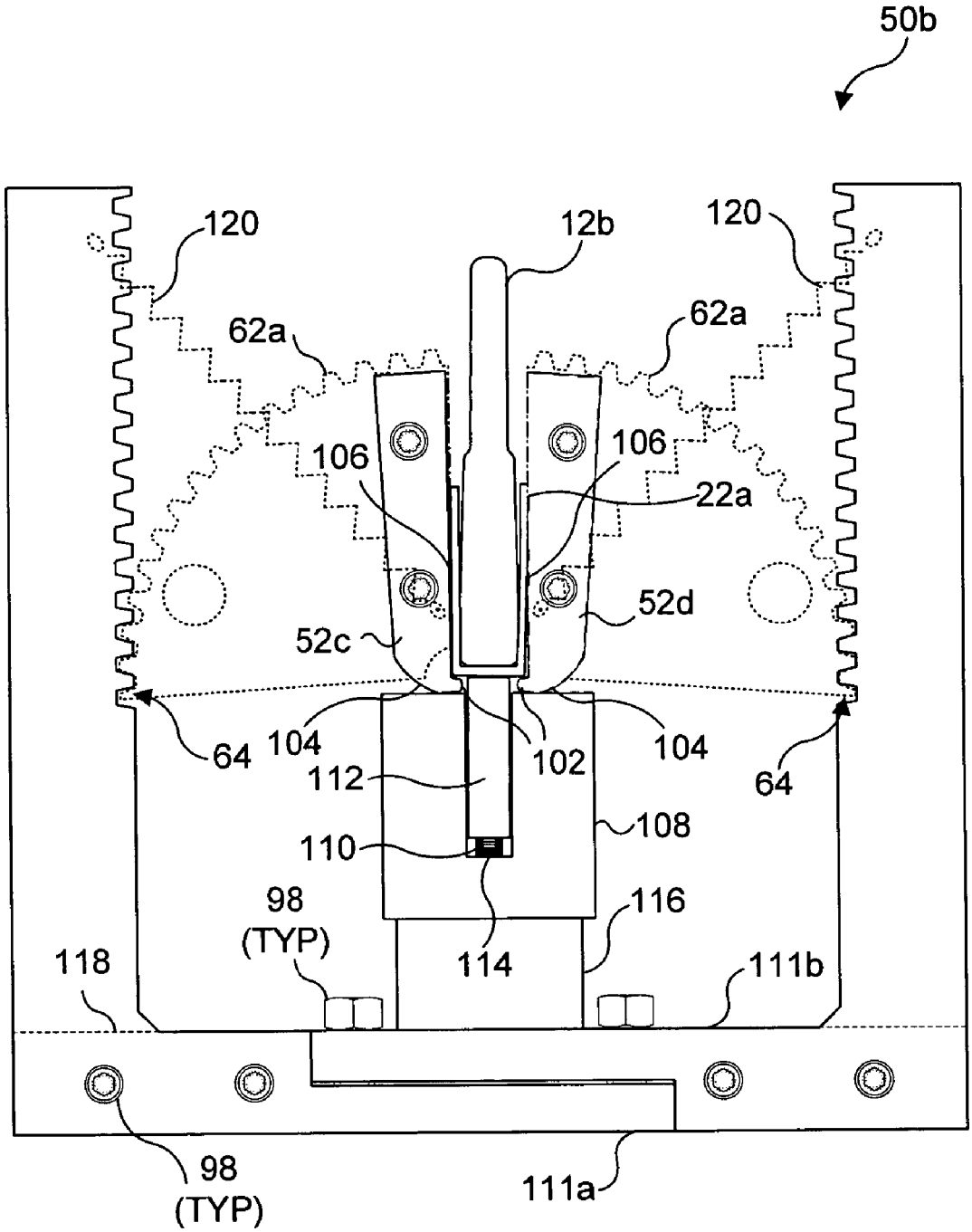

FIGS. 9B-9D show flanged plate 52*c* attached to sector gear 62 using two threaded fasteners 98. FIG. 9C shows hinge arm 68*a* attached to the flanged plate/sector gear combination of FIG. 9B using threaded fastener 98*a* and a nut (not shown). FIG. 9D shows a slightly modified sector gear 62*a* coupled to flanged plate 52*c*. Sector gear 62*a* follows the contours of angled surface 106 of flanged plate 52*c*. While not required for functionality, sector gear 62*a* is shown in FIGS. 10A-10C, because the inclusion of sector gear 62*a* (rather than sector gears 62) in those Figures enables the disposition of work piece 22*a* to be more clearly seen. While hinge assembly 66 and hinge arms 68*a* and 68*b* are preferably employed in bottom tool 50*b*, those elements have been omitted from FIGS. 10A-10C, to enable flange tips 102 and shoulder 104 to be more readily viewed. Again, it should be emphasized that while preferred in some embodiments, such hinge assemblies are not required. Sector gears 62*a* are shown in phantom view, for the same reason.

FIGS. 10A-10C illustrate metal forming steps using a bottom tool 50*b*, which enables a channel to be formed in a work piece in a single forming process. Some bending tools are able to make only a single bend at one time, and forming a channel typically (in the prior art) requires that a first 90 degree bend be formed, then the work piece is moved and a second 90 degree bend is formed, producing a channel. Bottom tool 50*b* is able to form a channel in a single forming step. Bottom tool 50*b* is similar to bottom tools 50 and 50*a* described above; the most significant differences being: (1) the use of the flanged plates described in conjunction with FIGS. 9A-9D, rather that the generally rectangular plates used in bottom tools 50 and 50*a*; and, (2) the addition of a support that is in contact with the flanged plates. As shown in FIGS. 10A-10C, one embodiment of such a support includes a movable support 108 and a telescoping, collapsible support 116. Those of ordinary skill in the art will recognize that movable support 108 and collapsible support 116 function in combination to provide a resist force. While movable support 108 and collapsible support 116 represent one embodiment for providing such a resist force, many alternative components can be beneficially employed to provide a resist force. Springs, hydraulic systems, and blocks of elastomeric materials are often employed in bottom tools to provide a resist force, and it is contemplated that such elements can be beneficially employed to provide a resist force in the present invention. As those of ordinary skill in the art will recognize, the magnitude of the resist force required is at least in part a function of the material that is to be deformed. It should therefore be understood that movable support 108 and collapsible support 116 are merely exemplary, and should not be considered to limit the scope of the invention.

As shown in FIGS. 10A-10C, the generally U-shaped brackets at opposite ends of the bottom tools are fabricated from individual generally L-shaped brackets 111*a* and 111*b*. In this embodiment, L-shaped brackets that are slightly different but similar to those on bottom tool 50 are used in bottom tool 50*b*. FIGS. 10A-10C represent end views of bottom tool 50*b*, in which only a single generally U-shaped bracket is shown. It should be understood, however, that bottom tool 50*b* is similar to bottom tools 50 and 50*a*, in that a generally U-shaped bracket is disposed at each end of the bottom tool.

Referring now to FIG. 10A, note that work piece 22*a* is primarily supported by flange tips 102 on each flanged plate. As shown, work piece 22*a* is sufficiently long that part of angled surface 106 of each flanged plate also provides some support to the work piece. A punch 12*b* is positioned immediately adjacent to the work piece, but no pressure is yet applied to the work piece by this upper tool. As will be described in more detail below, proper positioning of the upper tool or punch relative to the movable support 108 is necessary. Flanged plates 52*c* and 52*d* are attached to respective sector gears 62*a* by fasteners 98, generally as described above. Each sector gear engages its own rack 64, also as described above. Springs 120 (shown in phantom view) couple each sector gear to its corresponding L-shaped bracket, such that the sector gears will move back up within their respective racks, and plates 52*c* and 52*d* will return to their undeflected positions, when as the force applied by punch 12*b* is removed.

Figure 10D:
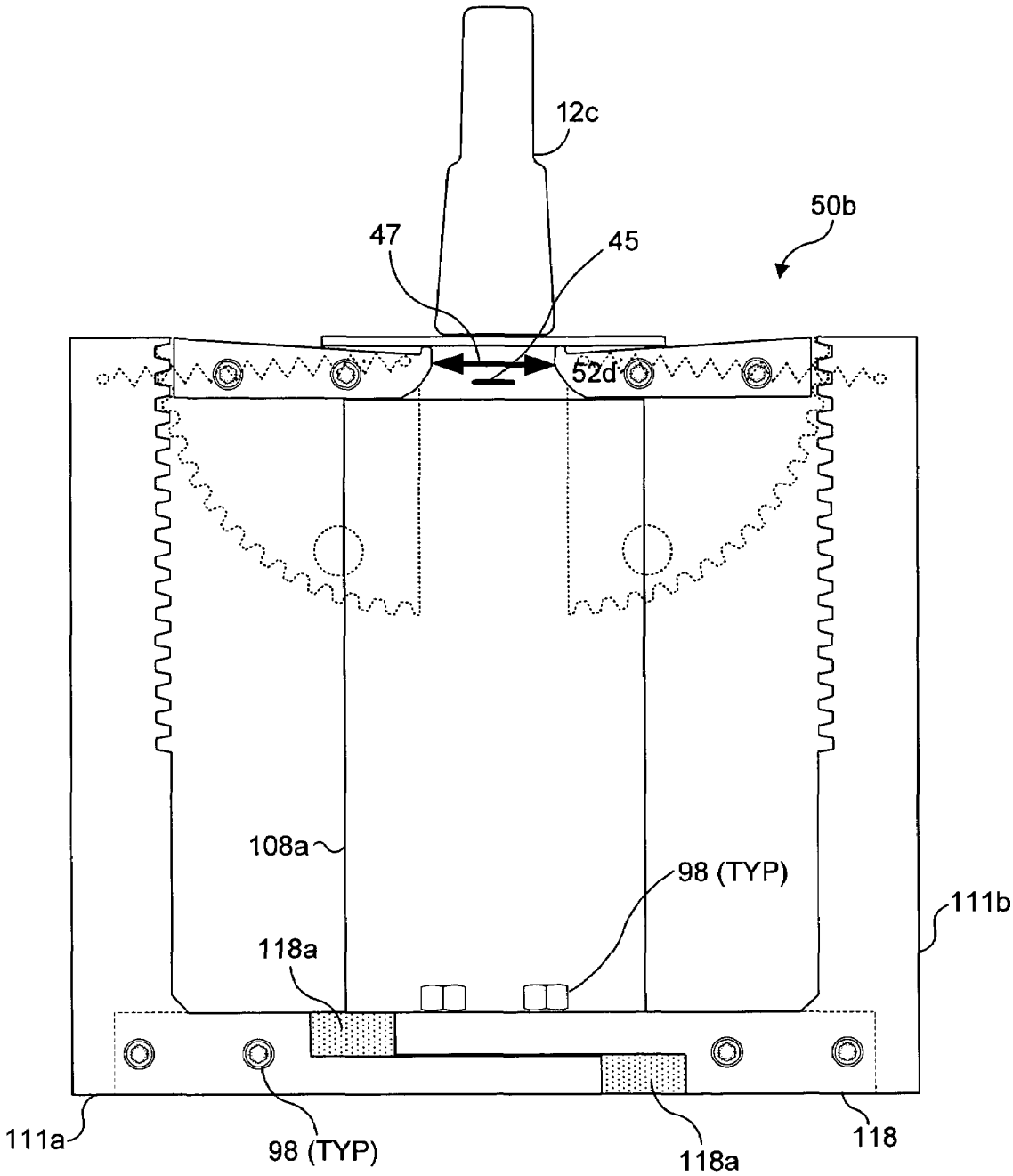

Movable support 108 is a generally block shaped unit that preferably is as long as each flanged plate (52*c* and 52*d*), such that the movable support generally spans the distance between each generally U-shaped bracket disposed at opposed ends of bottom tool 50*b*. Movable support 108 includes an elongate channel 110, into which an elongate block 112 is disposed. Those of ordinary skill in the art will recognize that elongate block 112 is often referred to as a stripper. While the use of a stripper in tool 50*b* is preferred, a stripper is not required in the bottom tool, and functional bottom tools in accord with the present invention can be achieved without employing a stripper. A helical spring 114 applies an upwardly directed force onto elongate block 112, causing elongate block to float within channel 110. Preferably, in the relaxed position (i.e. when spring 114 is uncompressed) spring 114 causes elongate block 112 to engage with work piece 22*a*. Note that punch 12*b* is generally aligned with channel 110, so that elongate block 112 applies a resistive force opposite the downward force applied by punch 12*b*. Note also that a width of elongate block 112 (and a width of channel 110) generally correspond to a width of the channel to be formed. A different movable support, having a wider channel and a wider elongate block, will be used to form wider channels, and conversely, a movable support having a narrower channel and a narrower elongate block will be used to form narrower channels. To deform a work piece to achieve a wider/narrower channel, the gap between flange tips 102 will require adjustment. To achieve a different gap, brackets 111*a* and 111*b* are moved relative to each other, as indicated in FIG. 10D, and as explained in greater detail below.

Referring once again to FIG. 10A, bottom tool 50*b* also includes telescoping, collapsible support 116, which is fixedly attached to a bottom plate 118 (shown in phantom view). Bottom plate 118 extends between each generally U-shaped bracket disposed at opposed ends of bottom tool 50*b*. L-shaped brackets 111*a* and 111*b* are preferably attached together to form a generally U-shaped bracket with threaded fasteners 98, while other fasteners 98 attach the L-shaped brackets to the bottom plate. As discussed above, the specific fastener means employed to connect the components together is not critical, and the use of other types of fasteners is contemplated.

Collapsible support 116 preferably includes a plurality of sections that telescope together as downward pressure is applied by movable support 108. Not shown are helical coil springs that are internally fitted within each section of the collapsible support to provide a force that resists the collapsing of the support sections together. As noted above, it is contemplated that a resist force can be provided using springs, pneumatic components, hydraulic components, and/or elastomeric materials in place of or in addition to collapsible support 116 and movable support 108. As punch 12*b* applies downward force against work piece 22*a*, the work piece in turn applies a downward force on flange tips 102. Flanged plates 52*a* and 52*b* each apply a downward pressure on movable support 108 as the flanged plates rotate and travel along racks 64. Preferably, the amount of force required to collapse each section of collapsible support is selected to produce a desired amount of resistance to the downward pressure applied by the upper tool. It should be noted that other means of providing support for movable support 108, and resistance to the downward force applied by the upper tool, could be provided. For example, other types of spring devices, such as a torsion spring, can be employed to provide the upward force as an alternative to collapsing support 116.

In FIG. 10B, punch 12*b* is shown applying a downward force to work piece 22*a*, causing flanged plates 52*c* and 52*d* to be deflected downward, and work piece 22*a* to be deformed. Each sector gear 62*a* is thus caused to be move downwardly in its corresponding rack 64, because the sector gears are attached to plates 52*c* and 52*d*. Helical springs 120 are elongated, such that when punch 12*b* is removed, the force produced by the helical springs causes the sector gears to move back up along their respective racks, and plates 52*c* and 52*d* to return to their undeflected positions. Elongate block 112 is firmly in contact with work piece 22*a*, and spring 114 is partially compressed, as the downward force applied by punch 12*b* causes the elongate block to move downwardly within channel 110.

In FIG. 10B, several sections of collapsing support 116 are shown collapsed, enabling movable support 108 to move downwardly. Note that if movable support 108 were not allowed to move, that flanged plates 52*c* and 52*d* would not be able to be deflected downward in response to force being applied by punch 12*b*. Note also that the relative positions of sector gears 62*a*, flanged plates 52*c* and 52*d*, movable support 108, elongate block 112, and collapsing support 116 are determined by the amount of downward force applied by punch 12*b*.

With respect to the relative position of work piece 22*a*, note that as the work piece is being deformed, a larger area of the work piece is in contact with the angled portions of the flanged plates. The purpose of the angled portion is to enable over-bending to be accomplished. Those of ordinary skill in the art will recognize that over-bending is a technique employed to overcome spring-back. As the punch is released, the work piece often exhibits less of a bend than was obtained when the punch was applying force to bend the work piece. This phenomena is referred to as spring-back. The amount of spring-back depends on the material, thickness, grain and temper, and can range from 5 to 10 degrees. Over-bending is simply the technique of bending the work piece slightly more than desired in the formed work piece, so that when spring-back occurs, the actual bend obtained will be substantially as desired.

With respect to the relative positions of flanged plates 52*c* and 52*d* and movable support 108, note that as the flanged plates are deflected, different portions of shoulders 104 of each flanged plate contact movable support 108. The curved shape of shoulders 104 facilitates the movement of the flanged plates relative to the movable support.

Referring now FIG. 10C, punch 12*b* has moved farther downward, applying more downward force to work piece 22*a*, causing flanged plates 52*c* and 52*d* to be still further deflected, and a channel is formed into work piece 22*a*. Note each sector gear 62*a* has been deflected by almost 90 degrees, which is more than can be accommodated by the design shown for bottom tools 50 and 50*a*. Helical coil springs 120 are elongated, providing a restoring force to cause the flanged plates and sector gears to be returned to their undeflected positions when punch 12*b* and the formed work piece are removed.

The lower portion of the channel formed in work piece 22*a* is supported by both flange tips 102 of the flanged plates, and by elongate block 112. Additional sections of collapsing support 116 have collapsed, and movable support 108 has been deflected downwardly to a greater extent. Preferably, once punch 12*b* and work piece 22*a* are removed, collapsing support 116 will return to its uncollapsed position, and movable support 108 will return to its undeflected position. The shape of punch 12*b* has been selected to facilitate the formation of a specific width channel in the work piece. Punch 12*a* (see FIGS. 7A-7C) would not produce the desired channel that is formed by punch 12*b*.

Referring now to FIG. 10D, it should be noted that many of the reference numbers shown in FIGS. 10A-10C have been deleted from FIG. 10D, to reduce the complexity of the Figure so that the change in the gap size can be emphasized and clearly evident. For bottom tool 50*b* to achieve the configuration shown in FIG. 10D, fasteners 98 are first loosened, enabling brackets 111*a* and 111*b* to be repositioned relative to bottom plate 118. Portions of bottom plate 118 obscured from view by brackets 111*a* and 111*b* are indicated by dashed lines, while portions of bottom plate 118 that can be seen in the end view of FIG. 10D are indicated as shaded portions 118*a*. Movable support 108 and collapsible support 116 (of FIGS. 10A-10C) have been replaced by a block 108*a*, which generally represents a resist element capable of applying a resist force of the required magnitude. As discussed above, many different elements can be employed to achieve such a resist force, including but not limited to, hydraulic or pneumatic systems, springs, and elastomeric materials.

Because brackets 111*a* and 111*b* have been repositioned, the gap between the plate dies has increased. The term "gap" refers to the distance separating the flange tips of the opposed flanged plates. As FIGS. 10A-10C clearly show, the gap dimension directly controls the width of the channel to be formed in the work piece. FIG. 10C clearly shows that the width of the upper tool is selected to correspond to the width of the channel to be formed. An arrow 47 indicates the width of the new gap, while a line 45 indicates the width of the gap achieved when tool 50*b* is configured as illustrated in FIG. 10A. In FIG. 10D, a punch 12*c*, that more closely corresponds to the new gap size, replaces the punch shown in FIGS. 10A-10C.

Clearly, many different embodiments of the present invention are possible wherein a bottom tool maintains a fixed separation between the dies as the work piece is being deformed or bent. It should be noted that in some circumstances, the shape of a die results in some change to the separation between dies as the work piece is being deformed. Under such circumstances, the motion of dies in bottom tools in accord with the present invention can be defined in terms of a center of rotation of the such a die, and an inner edge of the die. FIGS. 11A-11C illustrate this point.

Consider dies 71, as shown in these Figures. As illustrated, each die 71 is a quarter round sector gear, with a portion of the die removed adjacent an inner edge 76 (indicated by a circle). Dies 71 also each include an outer edge 78 (as indicated by a square). Inner edge 76 and outer edge 78 are defined relative to a working surface 73, and a center of rotation 75 for die 73. That is, inner edge 76 is the edge of working surface 73 disposed closest to center of rotation 75, when the dies are in a rest position (as shown in FIG. 11A), while outer edge 78 is the edge of working surface 73 disposed farthest from the center of rotation 75.

The cutout adjacent to inner edge 76 would normally be supporting the work piece proximate to where a bend is being formed. Under most conditions, it would be desirable to provide as much support for the work piece as possible, and no cutout would be included. It is contemplated that there will be circumstances in which a cutout will be desired, and thus the present invention will be described in terms of the relationship of the inner edge to the center of rotation, as well as in terms of a fixed separation between adjacent inner edges.

Each die 71 in FIGS. 11A-11C has the same center of rotation. If, as described above, a frame can be adjusted to increase a separation distance between adjacent inner edges of opposed dies, then the centers of rotation for each of the dies will likely no longer overlap (as illustrated in FIGS. 12A-12C, where each die 71*a* has a different center of rotation). FIGS. 10A-10C show a sector gears 62*a* being rotated due to punch 12*b* applying a downward force onto a work piece, which in turn causes the rotation of the sector gear and die combination shown in those Figures. The range of motion for dies 71 is identical to the motion of the dies/sector gear combinations in FIGS. 10A-10C. Each die 71 can be considered to be a combination of a sector gear and a plate die (such as in tools 50 and 50*a*), or dies 71 can be a solid component where the teeth and working surface are formed from a single piece of material, as shown in FIG. 7D.

As noted, FIG. 11A illustrates a rest or undeflected position of the dies. In FIGS. 11B and 11C, a force has been applied to cause dies 71 to move. While in the examples of bottom tools discussed above, the force has been a downward force applied by a punch, as will be described in greater detail below, other forces can cause dies 71 to move. As dies 71 are moved (i.e., as the dies rotate about their centers of rotation 75), the relative positions of inner edge 76 and outer edge 78 do not change. That is, the circle corresponding to inner edge 76 is always disposed closer to center of rotation 75 than the square corresponding to outer edge 76.

Because dies 71 include a cutout portion immediately adjacent to the circle corresponding to inner edge 76, when two such dies are disposed in a facing relationship, the gap between the dies will change slightly as the dies are rotated. In FIG. 11B, the gap between the circles (i.e., circles corresponding to inner edges 76 on each die 71) has been reduced as compared to the gap in FIG. 11A, and in FIG. 11C, the gap between the opposed circles has been significantly reduced (the circles substantially overlap). Note that the presence of sheet metal in between opposing dies will prevent such overlap from occurring during bending operations, but the gap still varies, if opposed dies include such cutouts. The movement of each die 71 is such that a center of rotation 75 remains aligned along a vertical axis 77. As indicated in FIGS. 11A-11C, the center of rotation may not be physically connected to the die, but instead, may be a point disposed adjacent to the die.

Even though FIGS. 11A-11C show adjacent inner edges that do not maintain an absolute fixed separation, the separation varies by only a small amount, and thus can be considered to be substantially fixed, particularly in comparison to the separation distance between inner edges in adjacent dies in the prior art, as discussed below.

FIGS. 12A-12C schematically illustrate the motion of dies 71*a*. Note that each die 71 a is a half round die, similar to those employed in prior art tools 30 and 30*a* of FIGS. 2A-2E. Each of dies 71*a* has a center of rotation 75*a*, and a working surface 73*a* that is in contact with sheet metal during bending operations. The centers of rotation are parallel, but do not overlap as in FIGS. 11A-11C. Both edges 78*a* and 76*a* of working surface 73*a* are equidistant from center of rotation 75*a*. Regardless of the rotated position of die 73*a*, as indicated in FIGS. 12A-12C, neither edge 76*a* nor edge 78*a* can be considered to be disposed closer to center of rotation 75*a*. Thus, even when dies include cutout portions, such as those in FIGS. 11A-11C, the dies and bottom tools in accord with the present invention are distinguished over the prior art by the relationship of the inner edge of the working surface relative to the center of rotation of the die.

Note in FIG. 12C how far apart edges 76*a* of dies 71*a* have moved, particularly as compared with the present invention, as shown in FIG. 11B. Thus, edges 76 of dies in a bottom tool in accord with the present invention maintain a substantially fixed separation, in contrast to prior art dies.

FIGS. 13A-13C schematically illustrate dies 71*b*-71*d* which include working surfaces that are not fully aligned with their respective centers of rotation. A working surface 73*b* of die 71*b* (FIG. 13A) is not fully aligned with a horizontal plane 81 that passes through center of rotation 75*b*, because a portion 79*a* extends above horizontal plane 81. When die 71*b* is incorporated into a bottom tool, raised portions 77 on opposed dies can contact when the dies are deflected to a large extent (for example, if the dies in bottom tool 50*a* of FIG. 7A includes raised portions 77, such raised portions can prevent the dies from having a free range of motion). Die 71*c* of FIG. 13B has a working surface 73*c* that includes a raised portion 79*b* that also extends above horizontal plane 81. Raised portion 79*b*, being disposed at a different position on die 71*c*, will not contact a similar raised portion 77*a* on an opposing die, until the dies have been displaced more fully (for example, see the displacement of the dies in FIG. 10C). It is contemplated that raised portions 79*b* can be beneficially employed in over-bending applications.

Die 71*d* (FIG. 13C) has a working surface 73*d* that includes a recessed portion 79*c*, which is lower than horizontal plane 81. Those of ordinary skill in the art will recognize that raised and recessed portions can be configured, even on the same die, to achieve specific results during metal forming applications. As shown in FIGS. 13A-13C, dies 71*b*-71*d* are elongate quarter round dies, like the die more clearly illustrated in FIG. 7D. It should be understood that dies formed by combining a sector gear and a plate can also include raised and recessed portions as part of the plate. As will be discussed in more detail below, dies in accord with the present invention are not required to include a sector gear, and can also include the raised or recessed portions noted above.

In the embodiments described above, a punch is forced into a work piece being supported by a bottom tool in accord with the present invention. It has also been noted that in some metal forming applications, the punch is placed in contact with a work piece, and then pressure is applied by the bottom tool being moved toward the punch, while the punch remains stationary. It is thus contemplated that bottom tools in accord with the present invention can be configured so that the dies in the bottom tool are driven, so as to provide some or all of the pressure required for metal forming, while the punch (or upper tool) remains in a substantially fixed position.

FIG. 14A schematically illustrates a first embodiment of a driven bottom tool in accord with the present invention. A bottom tool 150 includes a frame 162, in which are disposed two quarter round dies 156 coupled with sector gears 158. As illustrated, quarter round dies 156 are different than die 53 of FIG. 7D, as die 53 has teeth that extend along the entire length of the die. Quarter round dies 156 do not include teeth, but instead, relatively thin sector gears are attached to the ends of dies 156. Of course, such relatively thin sector gears could be coupled to plate dies instead of quarter round dies (generally as described above, in conjunction with bottom tools 50 and 50*a*). However, one advantage of employing quarter round dies 156 is that at each end of frame 162 openings 159 provide support for the quarter round dies 156 disposed within the openings, so that quarter round dies 156 rotatably engage the openings. Each sector gear 158 engages a driven gear 160. Each driven gear 160 is coupled to a shaft 164, which extends longitudinally through frame 162. At least one, and preferably both shafts are drivingly coupled to a prime mover, generally indicated by block 166.

Those of ordinary skill in the art will readily recognize that many different types of prime movers can be beneficially employed to cause shafts 164 to rotate. Such prime movers include, but are not limited to, electric motors (e.g., stepping motors), hydraulic pistons, and pneumatic pistons. If desired, each end of bottom tool 150 can include driven gears 160, such that four driven gears (two on each end) are employed. Preferably, each driven gear engages a corresponding sector gear. Placing driven gears and sector gears at each end of the dies facilitates securing the dies within the frame.

To prepare bottom tool for metal forming operations, a work piece 154 is placed on each die 156, and a punch 152 is brought into contact with the work piece. Punch 152 is immobilized, and the prime mover is engaged to drive the shafts, causing the driven gears and sector gears to rotate. Prime movers can be configured to drivingly couple with the driven gears, rather than with the shafts. As is clearly illustrated in FIG. 14B, as the sector gears rotate, the plate dies (or each combination sector gear/die) also rotate, forcing the work piece upward into punch 152, thereby deforming the work piece. In such an embodiment, the immobilized punch is providing a resist force. In some circumstances, it may be desirable to drive both the dies in the lower tool and the punch.

Driven bottom tools in accord with the present invention can also be configured to enable a gap between the opposing dies to be manipulated to facilitate the formation of a channel in a work piece, as is described in connection with FIGS. 10A-10D above. FIGS. 15A-15C schematically illustrate such an embodiment. In FIG. 15A, a bottom tool 150*a* has a two-piece frame, so that the gap between the opposed dies can be varied. A first frame 168 includes shaft 164, driven gear 160 and sector gear 158, generally as described above. As illustrated in FIGS. 15A-15C, dies 178 are shaped as elongated quarter rounds, as opposed to being plate dies as indicated in bottom tools 50, 50*a*, and 50*b*. A second frame 170 also includes shaft 164, driven gear 160 and sector gear 158. Each die 178 rotatably engages a cut out portion of the corresponding frame. Frame 168 includes two cut out portions 174, one at each end of frame 168. Frame 170 similarly includes two cut out portions 176, also one at each end of frame 170. The cut out portions provide support for the quarter round dies.

As noted above, at least one of the shafts (or driven gears) in bottom tool 150*a* is drivingly coupled to a prime mover. If one driven gear or shaft associated with one die can be driven independently of the shaft/driven gear associated with the other die, then the punch and the other die can be fixed in place, enabling only one portion of the work piece to be manipulated by the die that is being driven. This is also true of bottom tool 150.

As shown in FIGS. 15A-15C, sector gears and driven gears are disposed at only one end of bottom tool 150*a*. If desired, additional sector gears and driven gears can be disposed at the opposite ends of bottom tool 150*a*. Note a stripper 180 is preferably disposed in a gap between dies 178. As described above, such strippers provide support for the portion of a work piece in which a channel is to be formed, and strippers are matched to the size of the gap. While not specifically shown, it should be understood that first frame 168 and second frame 170 are removably fastened together, so that the fasteners can be loosened and the relative positions of the pistons adjusted, to vary a width of the gap between the opposed dies, before retightening the fasteners.

End blocks 182 are included in bottom tool 150*a* to secure dies 178 within the frames (one end block is removed to enable additional detail to be viewed in this Figure). The end blocks are secured to the frame, so that they remain in the indicated position, even when the dies are in motion. A pin (not separately shown) protruding from each end block is inserted in a corresponding orifice 181 in each die, such that the die is free to rotate about the pin. The pin keeps the die properly positioned within the frame, without interfering with the range of motion of the die. Each die includes a cutout 179, disposed such that a corresponding shoulder on each end block 182 engages the cutout. Again, the cutout enables the die to be properly positioned, while still allowing the die a range of motion. Because the end blocks do not move, even though an upper portion of the end blocks extend past the upper surface of the dies, those portions of adjacent end blocks do not contact when the dies are displaced.

In FIG. 15B, work piece 154 has been placed on dies 178, and punch 152 has been placed in contact with work piece 154. Once the prime mover is energized to drive one or both of dies 178, work piece 154 will be deformed. Preferably, both dies will be moved, and a channel will be formed into work piece 154 generally as described in regard to FIGS. 10A-10D. FIG. 15C illustrates additional details of stripper 180. Note that stripper 180 extends well below dies 178, to the base of the frame. It should be understood that stripper 180 provides a resist force, and can be implemented in a plurality of ways, generally as described above in regard to FIG. 10D, and more specifically, in regard to block 108*a* of that Figure.

As noted above, dies in accord with the present invention are not required to include a sector gear. While such sector gear elements provide a beneficial mechanism for controlling the motion of dies in bottom tools in accord with the present invention, other mechanisms can be employed to similarly control the motion of the dies. Bottom tools in accord with the present invention maintain a fixed (or substantially fixed) separation between the dies. A related aspect of the present invention is that the motion of a die in a bottom tool in accord with the present invention is about some center of rotation, such that regardless of the rotational position of the die in the bottom tool, the center of rotation of the die remains fixed.

FIG. 16 schematically illustrates a fixed frame bottom tool that does not employ sector gears, but instead includes hydraulic components to control the motion of the dies. Bottom tool 150*b* includes a fixed frame 162*a*, having opposed ends that each include generally circular openings 159, similar to those in bottom tool 150 of FIGS. 14A and 14B. Quarter round dies 178*a* are similar to dies 178 of FIGS. 15A-15C, except they are not required to include cutouts for mounting end block 182. Dies 178*a* remain properly positioned within the bottom tool because each die includes a wing 188 that is coupled to a piston 192. Each piston extends from a cylinder 190, which is attached to a bracket 186 mounted on frame 162*a*. Cylinders 190 are filled with a pressurized fluid that acts on piston 192. Also visible in FIG. 16 is punch 152, and work piece 154.

It is contemplated that bottom tool 150*b* can be configured to be a driven tool, or a stationary tool. When configured to be a stationary tool, the fluid acts as a resisting force countering a downward force applied by punch 152. Those of ordinary skill in the art will recognize that fluids (i.e., gases) of differing compressibility are available, such that the magnitude of the resisting force provided can be varied. The volume of fluid in cylinder 190 can also be varied to change the magnitude of the resisting force.

To configure bottom tool 150*b* as a driven tool, the fluid (i.e., a liquid) in each cylinder will be pressurized, such that the fluid in turn exerts a force on the piston. Hydraulic systems are well known in the art, and such systems can be employed to exert a driving force (via pistons 192 and wings 188) on dies 178*a*. Pneumatic pistons can also be beneficially employed. It is further contemplated that for a driven tool, cylinders 190 can include a prime mover (such as a stepper motor) drivingly coupled with pistons 192 (i.e., using a mechanical system as opposed to a hydraulic or pneumatic system). Regardless of whether piston 192 and cylinder 190 are a hydraulic, mechanical, or pneumatic system, each cylinder is preferably controllably coupled to an actuator 194 that produces or controls the pressurized fluid, to enable the movement of the pistons (and hence, the movement of dies 178*a*) to be controlled.

FIGS. 17A-17C schematically illustrate a bottom tool that includes the hydraulic system (or pneumatic system, or mechanical system) of FIG. 16, and an adjustable frame that enables a gap between opposed dies to be varied, thereby enabling a channel to be formed in a work piece. The adjustable frame includes a first frame 198 and a second frame 196. As discussed above, while not specifically shown, first frame 198 and second frame 196 are removably fastened together, such that the fasteners can be loosened and the relative lateral positions of the frames adjusted, to vary a width of the gap between the opposed dies. Each frame includes a cutout portion at each end in which the dies are rotatably supported. First frame 198 includes openings 183, while second frame 196 includes openings 185.

Dies 178*b* are positioned by wings 188, and end blocks 182. As explained above, dies 178*b* include cutouts 179 and orifices 181, to enable end blocks 182 to position the dies, while still enabling the dies to rotate. Wings 188 securely position dies 178*b*, however, end blocks 182 may be desired for additional security. As discussed above, when end blocks 182 are used, each die preferably includes cutouts configured to slidingly engage shoulders protruding from the end blocks.

A stripper 180 is included, disposed within the gap between the two dies. Different strippers can be used, depending on the size of the gap. Stripper 180 provides support for the portion of work piece 154 overlying the gap, as well as providing a resisting force to that portion. As discussed in detail above, other mechanisms can be employed to implement stripper 180.

As illustrated in FIG. 17A, each piston attached to wings 188 is fully enclosed within its corresponding cylinder 190. As the positions of the dies are changed, the pistons will emerge from the cylinders. Again, it is contemplated that bottom tool 150*c* can be configured as a driven tool, or a stationary tool. In a stationary configuration, pistons 192 and cylinders 190 provide a resisting force countering a downward force applied by moving punch 152. When configured as a driven tool, each cylinder in tool 150*c* will include preferably be energized with an actuator that exerts a force on the pistons coupled to wings 188. Again, such an actuator 194 can pressurize a fluid to drive the pistons (i.e., as in a hydraulic or pneumatic system), or the actuator can be a stepper motor that is mechanically coupled to the pistons (i.e., in a mechanical system). Regardless of whether pistons 192 and cylinders 190 correspond to a hydraulic, pneumatic or a mechanical system, each cylinder is preferably controllably coupled to actuator 194 to enable the movement of the pistons (and hence, the movement of dies 178*b*) to be controlled.

FIG. 17B shows bottom tool 150*c* from a different perspective, with an end block 182 removed to enable cutout portion 179 and orifice 181 of die 178*b* to be viewed. As noted above, while not required, cutouts 179 and orifices 181 are employed (along with end blocks 182) to secure and position each die. FIG. 17C shows bottom tool 150*c* from yet another perspective. One die 178*b* has been removed, to enable stripper 180 to more clearly be viewed.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A bending die for use in sheet metal forming, comprising:

(a) a first movable component including a first working surface, the first movable component and the first working surface extending longitudinally relative to a longitudinal axis of the bending die, the first working surface being generally planar and comprising a first inner edge extending longitudinally relative to the longitudinal axis of the bending die;

(b) a second movable component including a second working surface, the second movable component and the second working surface extending longitudinally relative to the longitudinal axis of the bending die and disposed adjacent to said first working surface, the second working surface being generally planar and comprising a second inner edge extending longitudinally relative to the longitudinal axis of the bending die, the first inner edge and the second inner edge being oriented substantially adjacent to one another in a facing relationship;

(c) a frame configured to provide support for said first and second movable component, while enabling said first and second working surfaces to move relative to the frame, such that a substantially fixed separation between the first inner edge and the second inner edge is maintained, regardless of a rotational angular displacement of either of the first and second movable components, the frame supporting the first and second movable components, wherein a first sector gear engages a first linear rack gear that is attached to the frame to movably support the first movable component, a second sector gear engages a second linear rack gear that is attached to the frame to movably support the second movable component, the first linear rack gear and the second linear rack gears being oriented parallel to each other, the first sector gear and second sector gear being disposed generally adjacent to one another; and (d) a hinge assembly coupling the first sector gear to the second sector gear, such that a rotational displacement of one of said first and second working surfaces results in a corresponding rotational displacement of the other of said first and second working surfaces, but in an opposite rotational direction, the hinge assembly comprising a first link and a second link joined by a pivot shaft, the first link being coupled to the first sector gear, and the second link being coupled to the second sector gear.

2. The bending die of claim 1, wherein said adjacent first inner edge and second inner edge are separated by a substantial gap having a predefined width, said substantial gap affecting a configuration of the sheet metal formed with the bending die.

3. The bending die of claim 1, wherein the adjacent first inner edge and second inner edge substantially abut one another.

4. The bending die of claim 1, wherein said frame comprises a first section and a second section, a position of said first section relative to said second section being adjustable to enable a width of a gap separating the adjacent first inner edge and second inner edge to be adjusted to a desired dimension.

5. The bending die of claim 1, wherein for each working surface:

(a) a center of rotation is associated with the working surface;

(b) relative to a portion of the working surface that is in contact with a metal sheet during metal forming, the center of rotation is disposed proximate to an inner edge of said portion; and (c) regardless of the rotational angular displacement of the working surface, the center of rotation remains substantially fixed relative to each working surface.

6. The bending die of claim 1, wherein said frame includes a generally U-shaped portion defined by support members disposed adjacent to the end of one of the first and second working surfaces, such that each rack gear is attached to a different support member.

7. The bending die of claim 1, further comprising a resist element that applies a resisting force to said first and second working surfaces, the resisting force countering at least in part a force applied to deform the sheet metal.

8. A press brake for use in sheet metal forming, comprising:

(a) a first die extending longitudinally relative to a longitudinal axis of the press brake, said first die including a working surface configured to support a work piece, said working surface having an inner edge and an outer edge and being generally planar;

(b) a first sector gear configured to rotatably support the first die;

(c) a second die extending longitudinally relative to the longitudinal axis of the press brake and disposed adjacent to said first die, said second die including a working surface configured to support a work piece, said working surface having an inner edge and an outer edge and being generally planar;

(d) a second sector gear configured to rotatably support the second die;

(e) a frame coupled to and supporting said first and second dies, while enabling said first and second dies to move relative to the frame, such that each die is able to rotate about a different respective center of rotation, and so that regardless of any rotational angular displacement of the die relative to the frame, the inner edge of the die is disposed closer to the respective center of rotation of the die than the outer edge of the die, the frame supporting the first and second dies, the first sector gear engaging a first linear rack gear that is attached to the frame, the second sector gear engaging a second linear rack gear that is attached to the frame, the first and second linear rack gears being oriented substantially parallel to each other; and (f) a hinge assembly coupling the first sector gear to the second sector gear, such that a rotational displacement of one of said first and second dies results in a corresponding rotational displacement of the other of said first and second dies, but in an opposite rotational direction, such that the hinge assembly does not extend between the inner edges of the first and second dies, the hinge assembly comprising a first link and a second link joined by a pivot shaft, the first link being coupled to the first sector gear, and the second link being coupled to the second sector gear.

9. The press brake of claim 8, wherein a substantially fixed separation is maintained between adjacent inner edges of the first and second dies, regardless of the rotational angular displacement of either one of the first and second dies about its respective center of rotation.

10. The press brake of claim 9, wherein said frame is adjustable, so that said substantially fixed separation can be adjusted to a desired dimension, the desired dimension being substantially maintained regardless of the rotational angular displacement of either of the first and second dies.

11. The press brake of claim 8, further comprising at least one spring operatively coupled to at least one of the first and the second dies, producing a restoring force that acts to return said first die and said second die to their respective original positions, after they have been rotatably displaced.

12. The press brake of claim 8, further comprising means for applying a force to each of said first and second dies, the force being applied for one of:

(a) countering at least in part a force applied to deform the sheet metal; and (b) causing the rotational angular displacement of said first and second dies, in order to achieve a desired deformation of the sheet metal.

13. The press brake of claim 12, wherein said means comprises one of a spring, an elastomeric material, a hydraulic system, and a pneumatic system.

14. A bending die for use in sheet metal forming, comprising:

(a) a first working surface extending longitudinally relative to a longitudinal axis of the bending die, a sector gear being coupled to said first working surface;

(b) a second working surface extending longitudinally relative to the longitudinal axis of the bending die and disposed adjacent to said first working surface, a sector gear being coupled to said second working surface;

(c) a frame configured to provide support for said first and second working surfaces, while enabling said first and second working surfaces to move relative to the frame, such that a substantially fixed separation between adjacent edges of the first and second working surfaces is maintained, regardless of a rotational angular displacement of either of the first and second working surfaces; and (d) a hinge assembly disposed at an end of the first and second working surfaces, the hinge assembly pivotally coupling said first and second working surfaces together, such that a rotational displacement of one of said first and second working surfaces results in a corresponding rotational displacement of the other one of said first and second working surfaces, through an opposite rotational direction, the hinge assembly comprising a first link and a second link joined by a pivot shaft, the first link being coupled to the sector gear coupled to the first working surface, and the second link being coupled to the sector gear coupled to the second working surface.

15. A bending die for use in sheet metal forming, comprising:

(a) a first working surface extending longitudinally relative to a longitudinal axis of the bending die;

(b) a second working surface extending longitudinally relative to the longitudinal axis of the bending die and disposed adjacent to said first working surface;

(c) a frame configured to provide support for said first and second working surfaces, while enabling said first and second working surfaces to move relative to the frame, such that a substantially fixed separation between adjacent edges of the first and second working surfaces is maintained, regardless of a rotational angular displacement of either of the first and second working surfaces;

(d) a first hinge assembly comprising a first sector gear and a second sector gear that are physically linked together, each of the first and the second sector gears engaging a rack gear that is mounted on the frame, the first sector gear supporting the first working surface, and the second sector gear supporting the second working surface, the first hinge assembly further comprising a first link and a second link joined by a pivot shaft, the first link being coupled to the first sector gear, and the second link being coupled to the second sector gear; and (e) a second hinge assembly comprising a third sector gear and a fourth sector gear that are physically linked together, each of the third and the fourth sector gears engaging a rack gear that is mounted on the frame, the third sector gear supporting the first working surface, and the fourth sector gear supporting the second working surface, each hinge assembly pivotally coupling said first and second working surfaces together, such that a rotational displacement of one of said first and second working surfaces results in a corresponding rotational displacement of the other one of said first and second working surfaces, but in an opposite rotational direction, without requiring the hinge assemblies to extend between opposed inner edges of the first and second working surfaces, the second hinge assembly further comprising a third link and a fourth link joined by a pivot shaft, the third link being coupled to the third sector gear, and the fourth link being coupled to the fourth sector gear.

16. A press brake for use in sheet metal forming, comprising:

(a) a first die extending longitudinally relative to a longitudinal axis of the press brake, said first die including a working surface configured to support a work piece, said working surface having an inner edge and an outer edge;

(b) a second die extending longitudinally relative to the longitudinal axis of the press brake and disposed adjacent to said first die, said second die including a working surface configured to support a work piece, said working surface having an inner edge and an outer edge;

(c) a first rack and sector gear structure configured to rotatably support the first die;

(d) a second rack and sector gear structure configured to rotatably support the second die; and (e) a frame coupled to and supporting said first and second rack and sector gear structures, the first and second rack and sector gear structures enabling said first and second dies to move relative to the frame, such that each die is able to rotate about a different respective center of rotation, and so that regardless of any rotational angular displacement of the die relative to the frame, the inner edge of the die is disposed closer to the respective center of rotation of the die than the outer edge of the die, the first rack and sector gear structure being fixed in a position relative to a first section of the frame, the second rack and sector gear structure being fixed in a position relative to a second section of the frame, a position of said first section relative to said second section being adjustable to enable a width of a gap separating adjacent inner edges of the working surfaces of the first and second dies to be adjusted to a desired dimension, the first and second rack and sector gear structures being coupled together via a hinge assembly comprising a first link and a second link joined by a pivot shaft, the first link being coupled to the first rack and sector gear structure, and the second link being coupled to the second rack and sector gear structure.

17. A bending die for use in sheet metal forming, comprising:

(a) a first working surface extending longitudinally relative to a longitudinal axis of the bending die;

(b) a second working surface extending longitudinally relative to the longitudinal axis of the bending die and disposed adjacent to said first working surface;

(c) a first rack and sector gear structure configured to rotatably support the first die;

(d) a second rack and sector gear structure configured to rotatably support the second die; and (e) a frame configured to provide support for said first and second rack and sector gear structures, while enabling said first and second working surfaces to move relative to the frame, such that a substantially fixed separation between adjacent edges of the first and second working surfaces is maintained, regardless of a rotational angular displacement of either of the first and second working surfaces, wherein said frame comprises a first section and a second section, a position of said first section relative to said second section being adjustable to enable a width of a gap separating adjacent inner edges of the first and second working surfaces to be adjusted to a desired dimension, the first and second rack and sector gear structures being coupled together via a hinge assembly comprising a first link and a second link joined by a pivot shaft, the first link being coupled to the first rack and sector gear structure, and the second link being coupled to the second rack and sector gear structure.

18. A bending die for use in sheet metal forming, comprising:

(a) a first working surface extending longitudinally relative to a longitudinal axis of the bending die;

(b) a second working surface extending longitudinally relative to the longitudinal axis of the bending die and disposed adjacent to said first working surface;

(c) a frame configured to provide support for said first and second working surfaces, while enabling said first and second working surfaces to move relative to the frame, such that a substantially fixed separation between adjacent edges of the first and second working surfaces is maintained, regardless of a rotational angular displacement of either of the first and second working surfaces; and (d) a hinge assembly disposed at a latitudinal end of the first and second working surfaces, the hinge assembly pivotally coupling said first and second working surfaces together, such that a rotational displacement of one of said first and second working surfaces results in a corresponding rotational displacement of the other of said first and second working surfaces, but in an opposite rotational direction, the hinge assembly being disposed generally orthogonal to the longitudinal axis of the bending die, wherein the hinge assembly comprises a first link and a second link joined by a pivot shaft, the first link being coupled to a first sector gear, and the second link being coupled to a second sector gear.

* * * * *